US009974703B2

(12) United States Patent
Richard

(10) Patent No.: US 9,974,703 B2
(45) Date of Patent: May 22, 2018

(54) SYSTEM FOR CONSTRUCTION OF AN ADJUSTABLE WHEELCHAIR AND METHOD OF USING THE SAME

(71) Applicant: Mark James Richard, Sioux Falls, SD (US)

(72) Inventor: Mark James Richard, Sioux Falls, SD (US)

( * ) Notice: Subject to any disclaimer, the term of this patent is extended or adjusted under 35 U.S.C. 154(b) by 0 days. days.

(21) Appl. No.: 15/591,106

(22) Filed: May 10, 2017

(65) Prior Publication Data

US 2017/0326008 A1 Nov. 16, 2017

Related U.S. Application Data

(60) Provisional application No. 62/334,352, filed on May 10, 2016.

(51) Int. Cl.

| | |
|---|---|
| ***A61G 5/08*** | (2006.01) |
| ***A61G 5/00*** | (2006.01) |
| *A61G 5/10* | (2006.01) |

(52) U.S. Cl.

CPC ..... *A61G 5/006* (2013.01); *A61G 5/08* (2013.01); *A61G 5/1059* (2013.01)

(58) Field of Classification Search

None

See application file for complete search history.

(56) References Cited

U.S. PATENT DOCUMENTS

| | | | |
|---|---|---|---|
| 2002/0170110 | A1 | 11/2002 | Hodgetts |
| 2003/0034635 | A1 | 2/2003 | Ludovici |
| 2004/0188979 | A1 | 9/2004 | Bematsky et al. |
| 2005/0012302 | A1 | 1/2005 | Lindkvist et al. |
| 2006/0087098 | A1 | 4/2006 | Peterson et al. |
| 2006/0087103 | A1 | 4/2006 | Schreiber et al. |
| 2009/0045002 | A1 | 2/2009 | Riemslag et al. |

*Primary Examiner* — John D Walters
*Assistant Examiner* — Hilary L Johns

(57) ABSTRACT

An adjustable wheelchair for ready assembly in accordance with embodiments of the invention are disclosed. In one embodiment, the wheelchair includes, an undercarriage including, a horizontal axle including a first end segment telescopically coupled to a body segment and a second end segment telescopically coupled to the body segment opposite the first end segment allowing for adjustment of the wheelchair width, and a tongue including a body segment telescopically coupled to an end segment allowing for adjustment of the wheelchair length, and a seat post including an end segment telescopically coupled to a body segment allowing for adjusting the wheelchair seat height; and a pair of wheels; and a swivel wheel coupled to the tongue of the undercarriage to support the wheelchair and provide mobility; and a seat bottom coupled to the end segment of the seat post for load-bearing support; and a seatback rotatably coupled to the seat bottom.

20 Claims, 25 Drawing Sheets

SYSTEM FOR CONSTRUCTION OF AN ADJUSTABLE WHEELCHAIR AND METHOD OF USING THE SAME

CROSS-REFERENCE TO RELATED APPLICATIONS

The current application claims priority to Provisional Patent Application No. 62/334,352 filed May 10, 2016, the disclosures of which are incorporated herein by reference.

FIELD OF THE INVENTION

The present invention generally relates to the field of adjustable wheelchairs and more specifically to a system for constructing an adjustable wheelchair.

BACKGROUND

Wheelchairs must be made to be extremely durable and robust since patients often use them daily for virtually all the time spent by the patient out of bed. The structural elements of conventional wheelchairs are typically made from segments using bent high grade, high strength stainless steel metal tubing, which are welded together using modern techniques. The construction requires skilled workers and metal working technologies that are well beyond the unskilled workers and simple metal workshops typically found in third world countries. The cost of manufacture, the cost of tooling, and the level of skill of the fabricator is high even in developed countries where demanding construction requirements can be met. Even if these materials, tooling and skills were available at third world manufacturing sites, the resulting costs would be far beyond that which could be afforded by a third world population. The result to disabled persons in the third world, who are not able to afford a wheelchair means that the disabled person must be bodily carried by a parent, sibling relative or friend to any location within or outside the home or even the patient's sleeping situs. Thus, in the third world, a disability typically means that the disabled person is condemned to a life of virtual home confinement with no access to educational, health or occupational locations or opportunities.

SUMMARY OF THE INVENTION

The various embodiments of the present systems and methods for constructing wheelchairs have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide the advantages described herein.

One aspect of the present embodiments includes the realization that current wheelchairs cannot be readily assembled or manufactured. In particular, in parts of the world where people lack manufacturing skills and/or tools, conventional wheelchairs made not be available. Thus, there is a need for wheelchairs that could be practically manufactured and used, but have the same utility, adaptability, adjustability and ruggedness of conventional wheelchairs.

Systems and methods for constructing wheelchairs in accordance with embodiments of the invention are disclosed. In one embodiment, a wheelchair for ready assembly may include an undercarriage comprising: a horizontal axle comprising a first end segment telescopically coupled to a body segment and a second end segment telescopically coupled to the body segment opposite the first end segment allowing for adjustment of the wheelchair width, wherein the body segment, the first end segment, and the second end segment each comprise a square bar tube, each square bar tube comprising a plurality of oppositely aligned through holes; and a tongue comprising a body segment telescopically coupled to an end segment allowing for adjustment of the wheelchair length, wherein the body segment and the end segment of the tongue each comprise a square bar tube, each square bar tube comprising a plurality of oppositely aligned through holes; and a seat post comprising an end segment telescopically coupled to a body segment allowing for adjusting the wheelchair seat height, wherein the end segment and the body segment of the seat post each comprise a square bar tube, each square bar tube comprising a plurality of oppositely aligned through holes, wherein the body segment of the seat post is coupled to the tongue of the undercarriage using a pair of seat post brackets having a plurality of interconnected and overlapping square holes for receipt of a carriage bolt; wherein the body segment of the horizontal axle and the body segment of the tongue are coupled using a pair of tongue brackets thereby coupling the horizontal axle to the tongue; and a pair of wheels for mobility comprising: a first wheel coupled to the first end segment of the horizontal axle using a first pair of wheel brackets having a plurality of interconnected and overlapping square holes for receipt of a carriage bolt to determine the angular orientation of the first wheel relative to the horizontal axle of the undercarriage; and a second wheel coupled to the second end segment of the horizontal axle using a second pair of wheel brackets having a plurality of interconnected and overlapping square holes for receipt of a carriage bolt to determine the angular orientation of the second wheel relative to the horizontal axle of the undercarriage; and a swivel wheel coupled to the tongue of the undercarriage to support the wheelchair and provide mobility; and a seat bottom coupled to the end segment of the seat post for load-bearing support; and a seatback rotatably coupled to the seat bottom for back support.

In a further embodiment, the first end segment of the horizontal axle is coupled to the body segment of the horizontal axle by inserting a first axle bolt through oppositely aligned through holes of the first end segment with oppositely aligned through holes of the body segment of the horizontal axle.

In another embodiment, the second end segment of the horizontal axle is coupled to the body segment of the horizontal axle by inserting a second axle bolt through oppositely aligned through holes of the second end segment with oppositely aligned through holes of the body segment of the horizontal axle.

In a still further embodiment, the end segment of the tongue is coupled to the body segment of the tongue by inserting a tongue bolt through oppositely aligned through holes of the end segment of the tongue with oppositely aligned through holes of the body segment of the tongue.

In still another embodiment, the end segment of the seat post is coupled to the body segment of the seat post by inserting a seat post bolt through oppositely aligned through holes of the end segment of the seat post with oppositely aligned through holes of the body segment of the seat post.

In a yet further embodiment, the first end segment of the horizontal axle and the second end segment of the horizontal axle and the body segment of the horizontal axle are all straight square bar tubes without curvature.

In yet another embodiment, the end segment of the tongue and the body segment of the tongue are straight square bar tubes without curvature.

In a further embodiment again, the end segment of the seat post and the body segment of the seat post are straight square bar tube without curvature.

In another embodiment again, wheelchair further comprises a pair of rotatable seat brackets having: a first rotatable seat bracket comprising: a first end portion pivotally coupled to the end segment of the seat post of the undercarriage; and a second end portion coupled to the seat bottom of the wheelchair to allow for adjusting seat tilt in space; and a second rotatable seat bracket comprising: a first end portion pivotally coupled to the end segment of the seat post of the undercarriage; and a second end portion coupled to the seat bottom of the wheelchair to allow for adjusting seat tilt in space; wherein the pair of rotatable seat brackets have an adjustable orientation.

In a further additional embodiment, the wheelchair has a gurney configuration such that the seatback aligns with the seat bottom to assume a horizontal position so that the wheelchair may function as a gurney.

In another additional embodiment, a method of fabricating a wheelchair, the method comprising: assembling an undercarriage having a horizontal axle, a tongue, and a seat post, wherein assembling the horizontal axle further includes: setting a wheelchair width using a first end segment telescopically coupled to a body segment and a second end segment telescopically coupled to the body segment opposite the first end segment, wherein the body segment, the first end segment, and the second end segment each comprise a square bar tube, each square bar tube comprising a plurality of oppositely aligned through holes; wherein assembling the tongue further includes: setting wheelchair length using a body segment telescopically coupled to an end segment, wherein the body segment and the end segment of the tongue each comprise a square bar tube, each square bar tube comprising a plurality of oppositely aligned through holes; wherein assembling the seat post further includes: setting wheelchair seat height using an end segment telescopically coupled to a body segment, wherein the end segment and the body segment of the seat post each comprise a square bar tube, each square bar tube comprising a plurality of oppositely aligned through holes; wherein assembling the undercarriage further includes: setting seat post tilt using a pair of seat post brackets to couple the body segment of the seat post to the tongue, wherein setting seat post tilt further includes selecting from a plurality of interconnected and overlapping square holes defined through the rotatable seat post brackets for receipt of a carriage bolt; and setting wheelchair base using a pair of tongue brackets to couple the body segment of the tongue to the horizontal axle thereby coupling the horizontal axle to the tongue; and providing wheelchair mobility using a pair of wheels, wherein providing wheelchair mobility further includes: setting wheel camber for a first wheel using a first pair of wheel brackets to couple the first wheel to the first end segment of the horizontal axle, wherein setting wheel camber further includes selecting from a plurality of interconnected and overlapping square holes defined through the first pair of wheel brackets for receipt of a carriage bolt to determine the angular orientation of the first wheel relative to the horizontal axle of the undercarriage; and setting wheel camber for a second wheel using a second pair of wheel brackets to couple the second wheel to the second end segment of the horizontal axle, wherein setting wheel camber further includes selecting from a plurality of interconnected and overlapping square holes defined through the second pair of wheel brackets for receipt of a carriage bolt to determine the angular orientation of the second wheel relative to the horizontal axle of the undercarriage; and providing additional wheelchair mobility and support using a swivel wheel, wherein providing additional wheelchair mobility and support further includes coupling the swivel wheel to the tongue of the undercarriage; and providing load-bearing support using a seat bottom, wherein providing load-bearing support further includes coupling the seat bottom to the end segment of the seat post; and providing back support using a seatback, wherein providing back support further includes coupling the seatback to the seat bottom.

In another further embodiment, setting the wheelchair width further includes coupling the first end segment of the horizontal axle coupled to the body segment of the horizontal axle by inserting a first axle bolt through oppositely aligned through holes of the first end segment of the horizontal axle with oppositely aligned through holes of the body segment of the horizontal axle.

In another additional embodiment, setting the wheelchair width further includes coupling the second end segment of the horizontal axle to the body segment of the horizontal axle by inserting a second axle bolt through oppositely aligned through holes of the second end segment of the horizontal axle with oppositely aligned through holes of the body segment of the horizontal axle.

In another still further embodiment, the setting wheelchair length further includes coupling the end segment of the tongue to the body segment of the tongue by inserting a tongue bolt through oppositely aligned through holes of the end segment of the tongue with oppositely aligned through holes of the body segment of the tongue.

In still another embodiment, the setting wheelchair seat height further includes coupling the end segment of the seat post to the body segment of the seat post by inserting a seat post bolt through oppositely aligned through holes of the end segment of the seat post with oppositely aligned through holes of the body segment of the seat post.

In a yet further embodiment, the setting wheelchair length further includes using all straight square bar tubes without curvature for the first end segment of the horizontal axle and the second end segment of the horizontal axle and the body segment of the horizontal axle.

In yet another embodiment, the setting wheelchair length further includes using straight square bar tubes without curvature for the end segment of the tongue and the body segment of the tongue.

In a further embodiment again, the setting wheelchair seat height further includes using straight square bar tubes without curvature for the end segment of the seat post and the body segment of the seat post.

In another embodiment again, the method further includes further comprising: providing adjustable seat tilt using a pair of rotatable seat brackets, wherein providing adjustable seat tilt further includes: coupling a first rotatable seat bracket, wherein coupling the first rotatable seat bracket further includes: pivotally coupling a first end portion to the end segment of the seat post of the undercarriage; and coupling a second end portion to the seat bottom of the wheelchair; and coupling a second rotatable seat bracket, wherein coupling the second rotatable seat bracket further includes: pivotally coupling a first end portion to the end segment of the seat post of the undercarriage; and coupling a second end portion to the seat bottom of the wheelchair; wherein providing adjustable seat tilt further includes an adjustable orientation using the pair of rotatable seat brackets.

In a further additional embodiment, the fabricating the wheelchair includes providing for a gurney configuration by aligning the seatback with the seat bottom to assume a horizontal position.

DETAILED DESCRIPTION OF THE DRAWINGS

Turning now to the drawings, wheelchairs having various components in accordance with embodiments of the invention are disclosed. In many embodiments, the wheelchair may include an undercarriage that comprises a plurality of segments composed of tubing as further described below. In various embodiments, the tubing may include (but not be limited to) square tubes, each having a plurality of oppositely aligned through circular holes defined through each of the four sides of the tubing that may be telescopically coupled as further described below. In some embodiments, the square tubes may be scrap material from sign posts and/or any other similar posts that has been discarded. In other embodiments, the squares tubes may be manufactured to be used in the construction of wheelchairs in accordance with embodiments of the invention. In some embodiments, the undercarriage may have an adjustable horizontal axle, an adjustable tongue, and an adjustable seat post for connecting various wheelchair accessories and/or parts using bolts without welding. In several embodiments, the wheelchair may also include a plurality of wheel brackets having a plurality of interconnected overlapping square holes for receipt of a carriage bolt to determine the angular orientation of wheels relative to the horizontal axle. The plurality of wheel brackets may be used to set the wheel camber to predetermined angles. In various embodiments, the wheelchair may further include a gurney configuration such that the seatback aligns with the seat bottom to assume a horizontal position so that the wheelchair may function as a gurney as further described below.

Wheelchairs for Ready Assembly

Figure 1A:
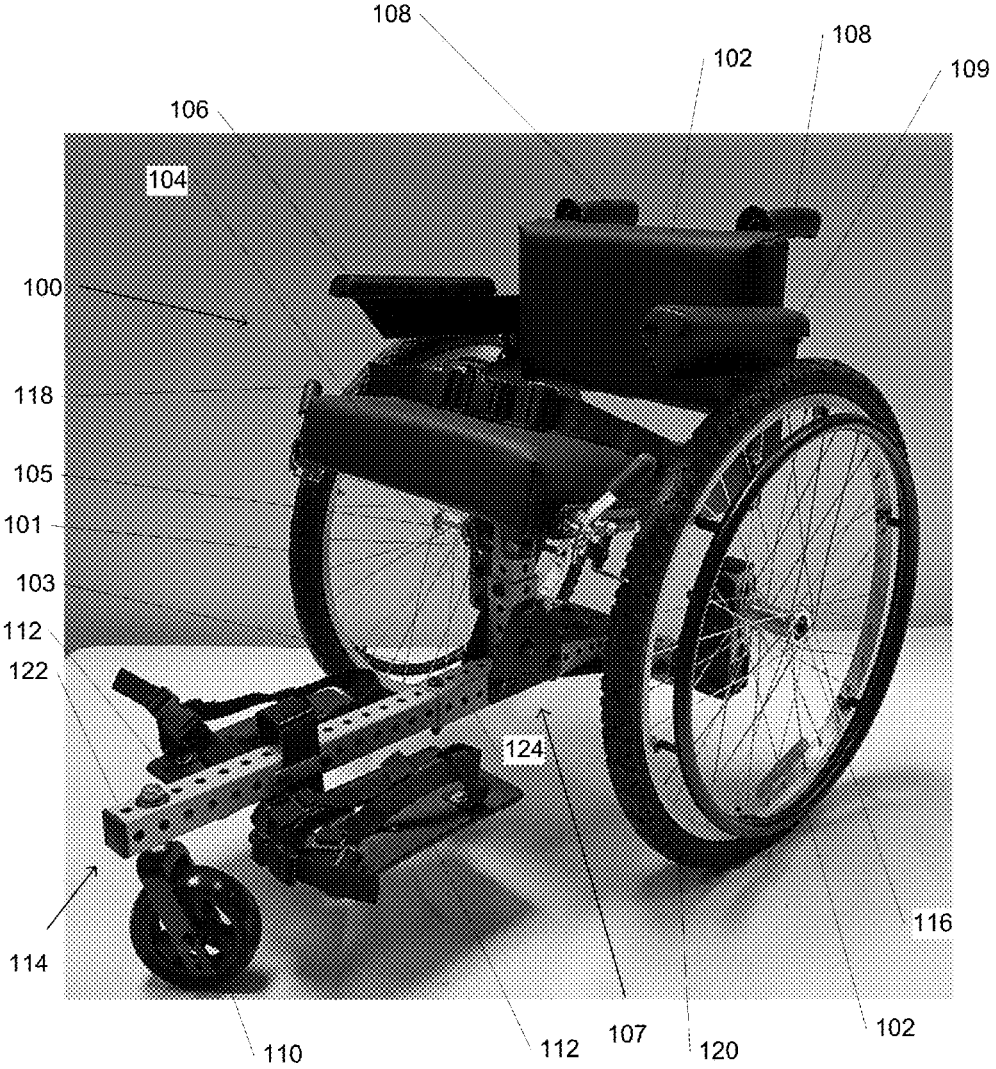
FIG. 1A is a front perspective view of a wheelchair in accordance with an embodiment of the invention.

Wheelchairs in accordance with embodiments of the invention can be readily assembled using specific parts and following specific construction methods. A front perspective view of an embodiment of a wheelchair is illustrated in FIG. 1A. The wheelchair 100 may include a first wheel 120 with a first circular hand ring 102 and a second wheel 101 with a second circular hand ring 103. In various embodiments, the wheels may include a solid rubber tire, spoked, metal wheel. In many embodiments, the first wheel 120 may rotate on a first bearing supported axle 116 and the second wheel 101 may rotate on a second bearing supported axle 105. The wheels 101, 120 are coupled in manner discussed further below to an undercarriage 107. In several embodiments, the undercarriage 107 also supports a seat bottom 104, a seatback 102, a first arm rest 109 and a second arm rest 106. In many embodiments, the seat bottom 104, the seatback 102, the first arm rest 109, and the second arm rest 106 may be padded to provide greater comfort for a patient. In various embodiments, an unpadded seat bottom, seatback, and arm rests can be substituted if desired for a special application where the wheelchair needs to be ruggedized or made waterproof. In many embodiments, a brake assembly 118 may be coupled to the seat bottom 104 for a patient to apply brakes to the wheels 101, 120 to slow or stop the wheelchair 100. In several embodiments, the first arm rest 106 and the second arm rest 106 are coupled to the seatback 102 with the first arm rest 109 extending over the first wheel 120 and the second arm rest 106 extending over the second wheel 101. In various embodiments, the seatback 102 may also be coupled to a pair of hand grips 108, which extend horizontally from the seatback 102 and provide conventional means for an attendant to push or guide wheelchair 100. In many embodiments, the undercarriage 107 includes a tongue 114 having an end segment 122 telescopically coupled to a body segment 124 in a manner further described below. In several embodiments, the tongue 114 of undercarriage 107 can extend forwardly from the undercarriage 107 and fitted with a swivel wheel 110. In various embodiments, a pair of foot stirrups 112 may be coupled to the tongue 114 and provide a convenient platform on which the seated patient can position his or her feet.

Figure 1B:
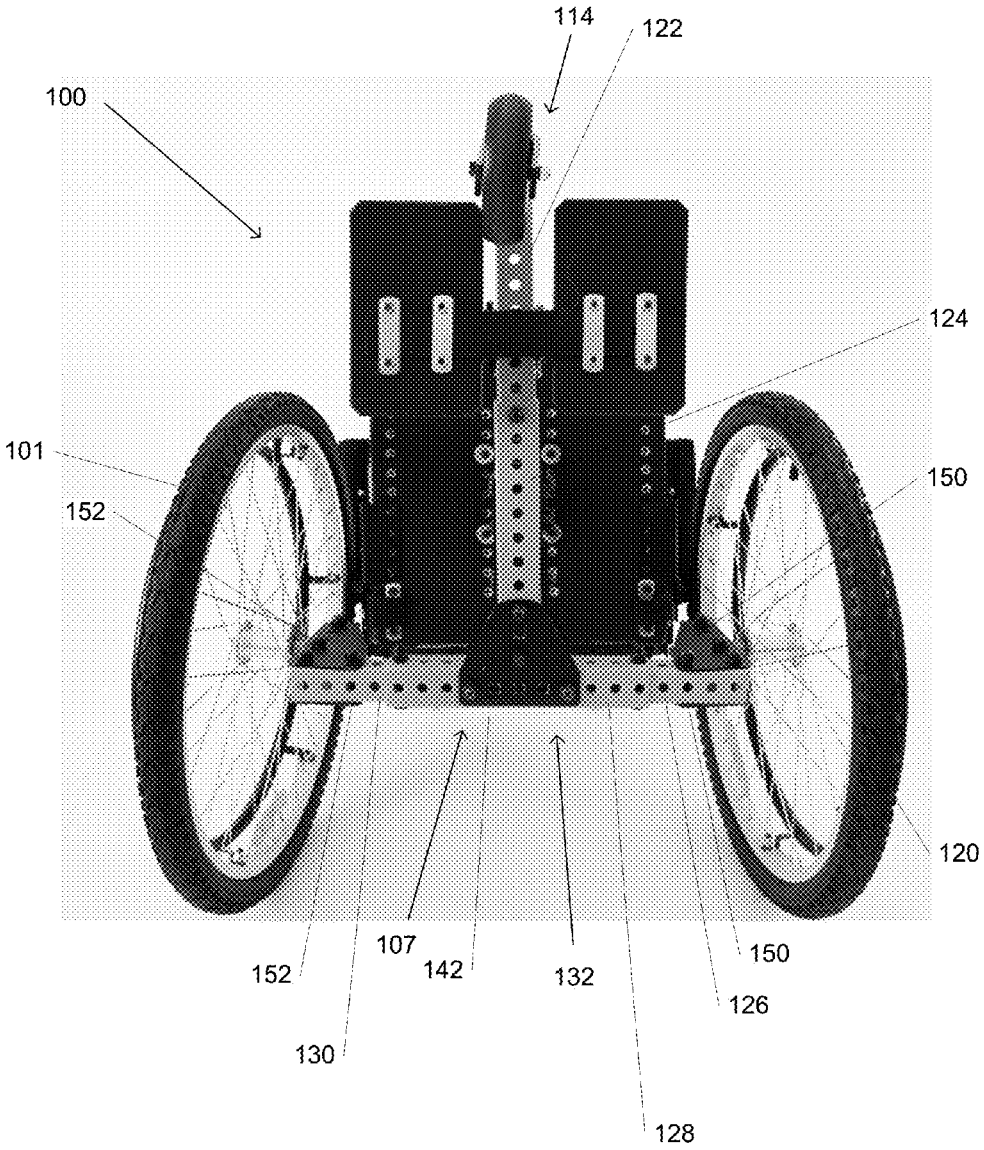
FIG. 1B is a bottom perspective view of the wheelchair of FIG. 1A without the brake assembly in accordance with an embodiment of the invention.

A bottom perspective view of the wheelchair of FIG. 1A is illustrated in FIG. 1B. The bottom perspective view shows the undercarriage 107 in clearer detail. In many embodiments, the undercarriage 107 may include a tongue 114 having an end segment 122 telescopically coupled to a body segment 124 in a manner further described below. In several embodiments, the undercarriage 107 may include a horizontal axle 132 having both a first end segment 126 and a second end segment 130 telescopically coupled to opposing ends of a body segment 128 in a manner further described below. In various embodiments, the tongue 114 may be coupled to the horizontal axle 132 using a pair of tongue brackets 142 (only one of which is visible in the depiction of FIG. 1B) in a manner further described below. In many embodiments, the first wheel 120 and the second wheel 101 may be coupled to the horizontal axle 132 using a first pair of wheel brackets 150 for the first wheel 120 and a second pair of wheel brackets 152 for the second wheel 101 in a manner further described below.

Figure 2A:
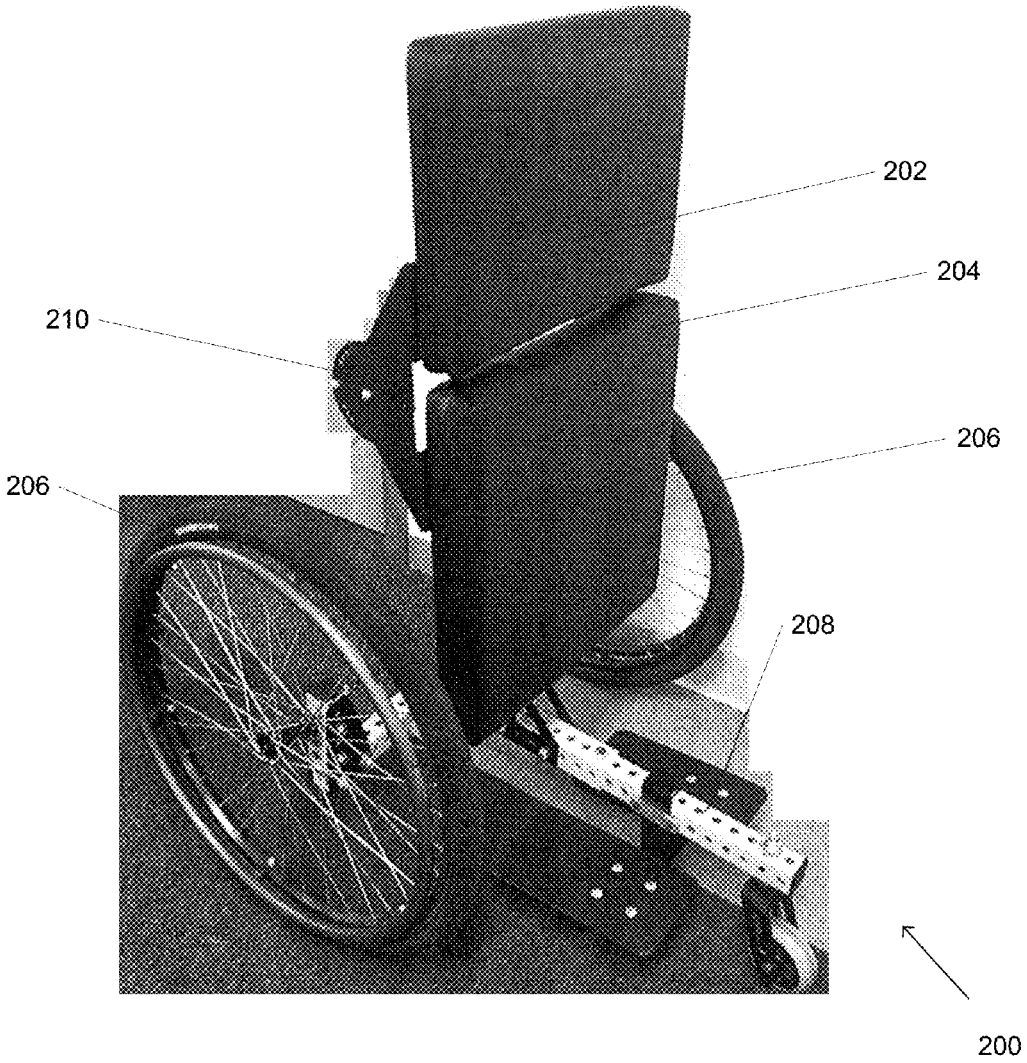
FIG. 2A is a front perspective view of a wheelchair in which a seat bottom and a seatback have been adjusted to be vertically oriented in accordance with an embodiment of the invention.
Figure 2B:
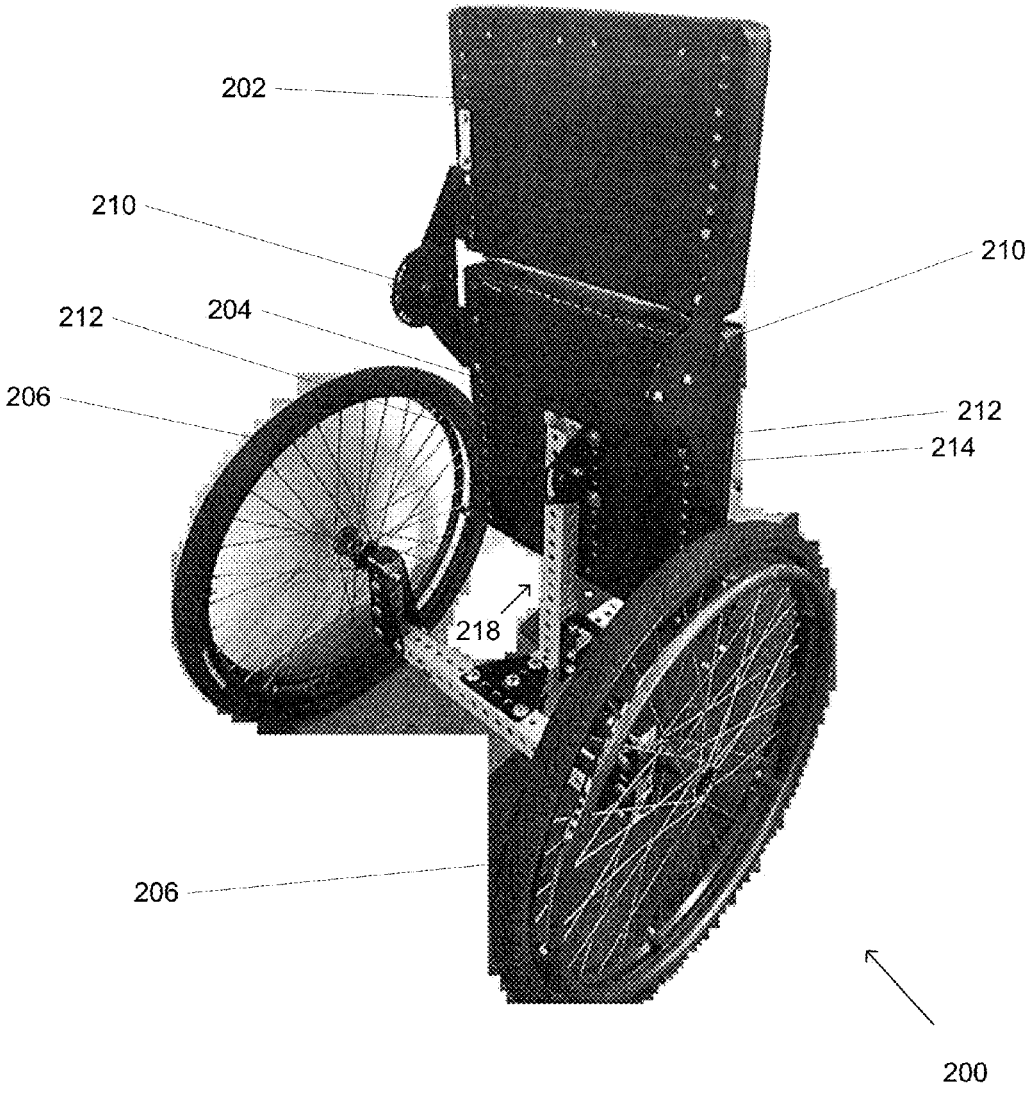
FIG. 2B is a rear perspective view of the wheelchair of FIG. 2A in accordance with an embodiment of the invention.

In many embodiments, the wheelchair may include a vertical storage configuration. A front perspective view of the wheelchair in which a seat bottom and a seatback have been adjusted to be vertically oriented in accordance with an embodiment of the invention is illustrated in FIG. 2A. The front perspective view shows a vertical storage configuration of a wheelchair 200 supported by a pair of wheels 206. In several embodiments, a seat bottom 204 may be inclined to a vertical position and a seatback 202 vertically aligned with the seat bottom 204 using a pair of adjustable locking hinge brackets 210 (only one of which is visible in FIG. 2A). This orientation may be provided for compact storage. A rear perspective view of the wheelchair 200 in which the seat bottom 204 and the seatback 202 have been adjusted to be vertically oriented in accordance with an embodiment of the invention is illustrated in FIG. 2B. The rear perspective view of the wheelchair 200 illustrated in FIG. 2B shows the pair of adjustable locking hinge brackets 210 and a pair of rotatable seat brackets 212 supported by the pair of wheels 206. In various embodiments, the pair of rotatable seat brackets 212 are rotated and locked to vertically orient the seat bottom 204 using a first bolt 214 that extends through opposing mutually aligned through holes in both the pair of rotatable seat brackets 212 and the seat post 218. In many embodiments, the pair of rotatable seat brackets 212 are bolted to the seat bottom 204.

Figure 12:
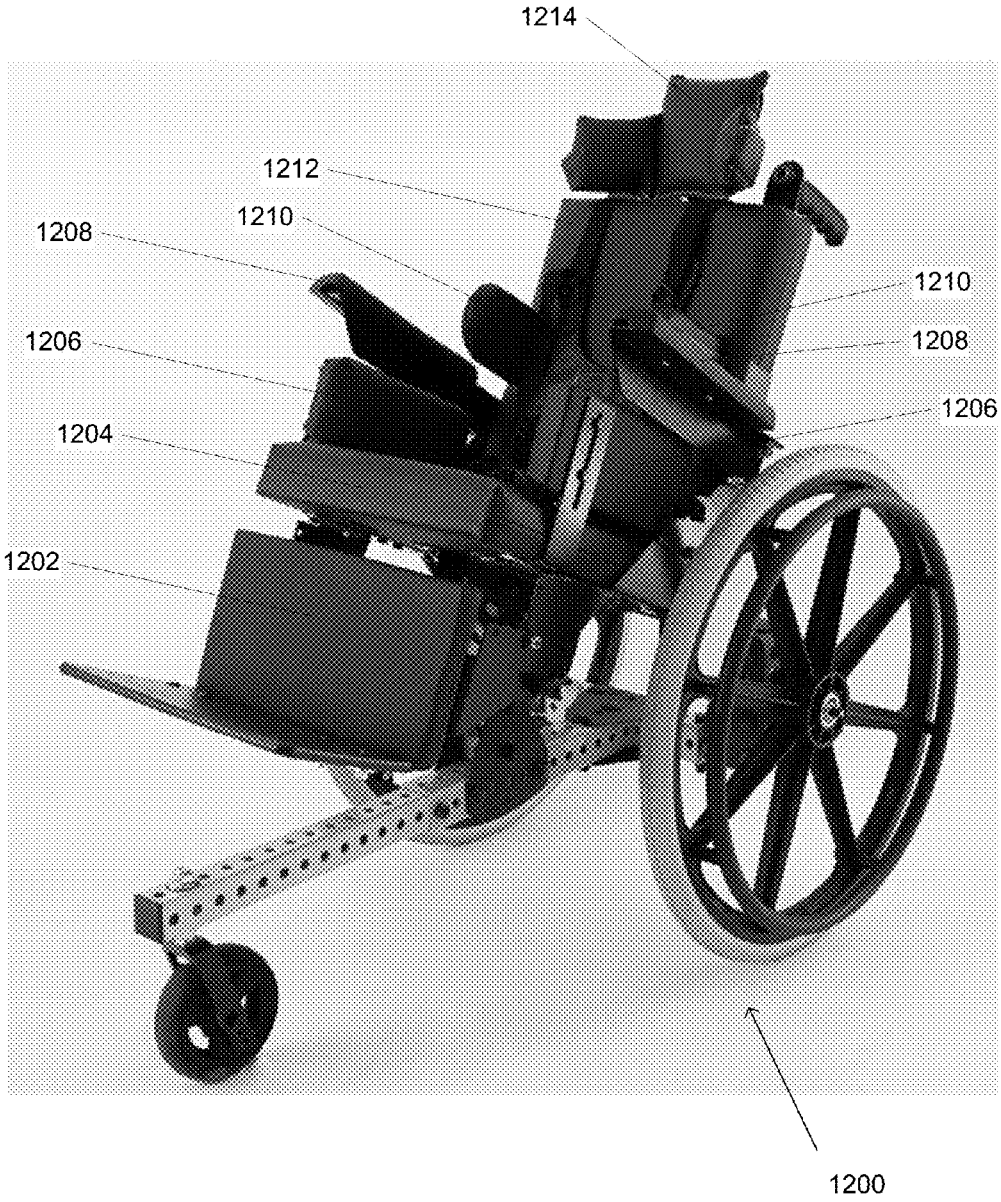
FIG. 12 is a front perspective view of a wheelchair in accordance with an embodiment of the invention.

In many embodiments, the wheelchair may include additional attachments, accessories, and padded platforms and the like to provide customized or specialized seating support for disabled persons. A front perspective view of a wheelchair 1200 including attachments in accordance with an embodiment of the invention is illustrated in FIG. 12. In several embodiments, the wheelchair 1200 includes a leg rest 1202 coupled to a seat bottom 1204. In various embodiments, a pair of side panels 1206 are coupled to the seat bottom 1204. In many embodiments, the seat bottom 1204 is coupled to the seatback 1212. In several embodiments, a pair of head rest panels 1210, a pair of arm rests 1208, and a head rest 1214 are coupled to the seatback 1212. In the illustrated embodiment, the leg rest 1202, the seat bottom 1204, the seatback 1212, the pair of head rest panels 1210, the pair of arm rests 1208, and the headrest 1214 are padded to provide greater comfort for a patient. In various embodiments, an unpadded leg rest, seat bottom, seatback, head rest panel, arm rests, and head rest can be substituted if desired for a special application where the wheelchair needs to be ruggedized or made waterproof.

Figure 13:
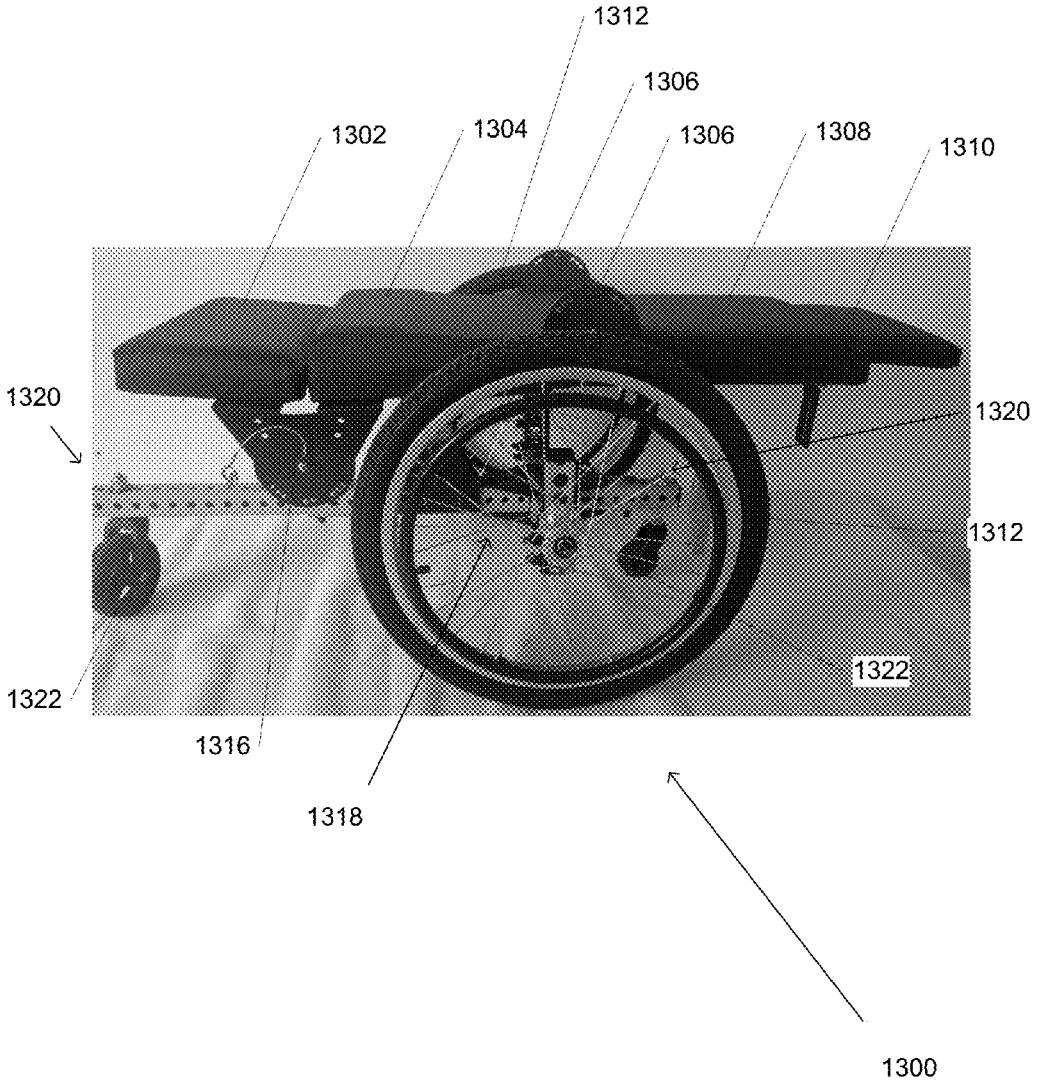
FIG. 13 is a side perspective view of the wheelchair in which a seat bottom and a seatback have been adjusted to be horizontally oriented in accordance with an embodiment of the invention.

In many embodiments, the wheelchair can include a gurney configuration. A side perspective view of the wheelchair in which a seat bottom and a seatback have been adjusted to be horizontally oriented in accordance with an embodiment of the invention is illustrated in FIG. 13. In the illustrated embodiment, the wheelchair 1300 is in a gurney configuration supported by a pair of wheels 1312, a pair of swivel wheels 1322, and an undercarriage 1318 including a pair of tongues 1320 for improved stability. In several embodiments, the wheelchair 1300 may include a first surface 1302 rotatably coupled by a first pair of locking hinge brackets 1316 (one of which is not visible in FIG. 13) to a seat bottom 1304. In various embodiments, the seat bottom 1304 may be rotatably coupled by a second pair of locking hinge brackets 1306 to a seatback 1308. In the illustrated embodiment, the first surface 1302, the seat bottom 1304, and the seatback 1308 are aligned by the first pair of locking hinge brackets 1316 and the second pair of locking hinge brackets 1306 to assume a horizontal position as part of the gurney configuration. In many embodiments, the seatback 1308 may be coupled to a second surface 1310. The surfaces 1302, 1310, seat bottom 1304, and the seatback 1308 may be padded to provide comfort for a patient.

Although specific wheelchairs for ready assembly having wheelchair components supported by an undercarriage are discussed above with respect to FIGS. 1A, 1B, 2A, 2B, 12, and 13, any variety of wheelchairs incorporating wheelchair components may be used in accordance with embodiments of the invention including coupling wheelchair components at various locations on the wheelchair. The wheelchair may also have an adjustable undercarriage in accordance with embodiments of the invention discussed further below.

Wheelchairs with Adjustable Undercarriage

Figure 3A:
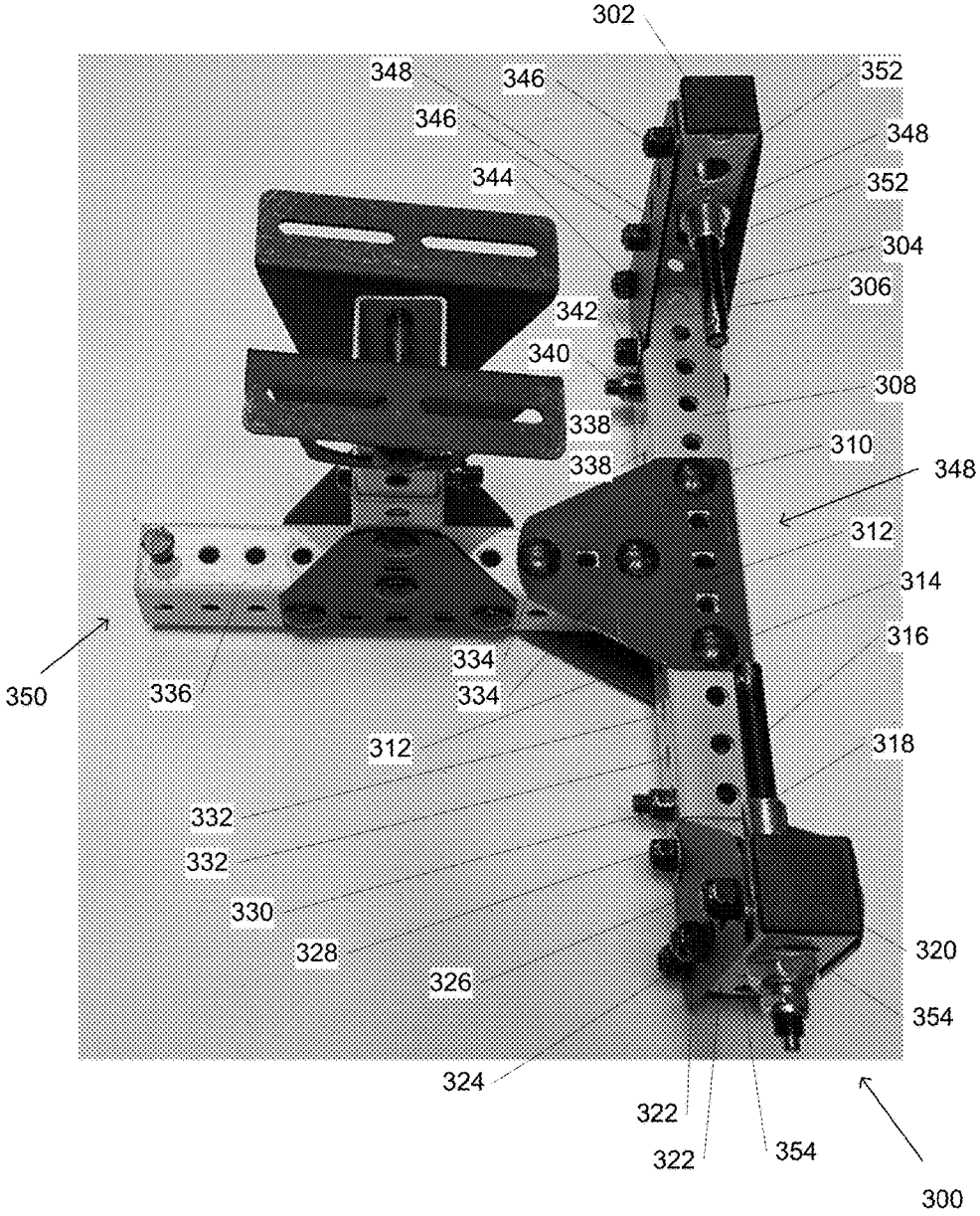
FIG. 3A is a front perspective view of an undercarriage of a wheelchair in accordance with an embodiment of the invention.

In many embodiments, a wheelchair includes an adjustable horizontal axle of an undercarriage to accommodate a range of patients, wheelchair configurations, and wheels. A front perspective view of an undercarriage of a wheelchair in accordance with an embodiment of the invention is illustrated in FIG. 3A. In several embodiments, the undercarriage 300 includes a horizontal axle 348 having both a first end segment 306 and a second end segment 318 telescopically coupled to opposing ends of a body segment 308. The first end segment 306, the second end segment 318, and the body segment 308 have a plurality of oppositely aligned, uniform through holes 338, 332 defined through all four sides and along each of the segments. In various embodiments, the first end segment 306 is telescopically coupled to the body segment 308 using a first axle bolt 340 that extends through opposing mutually aligned through holes in both the first end segment 306 and the body segment 308. In many embodiments, the second end segment 318 is telescopically coupled to the body segment 308 using a second axle bolt 330 that extends through opposing mutually aligned through holes in both the second end segment 306 and the body segment 308. Thus, a patient may selectively adjust and lock the width of the wheelchair by sliding the first end segment 306 or the second end segment 318 towards or away from the body segment 308 before locking the wheelchair width using the axle bolts 340, 330. In the illustrated embodiment, the undercarriage 300 is composed of all straight square bar tubing without curvature. One skilled in the art may appreciate that telescopically coupled square tubes assist in aligning through holes for receipt of a bolt because the rectangular prism shape limits rotational movement that may misalign the telescopically coupled square tubes. The undercarriage 300 tubing may be cane shaped to provide greater flexibility for possible through hole alignment for telescopically coupled tubes. In several embodiments, a body segment 336 of a tongue 350 may be coupled to the body segment 308 of the horizontal axle 348 using a pair of tongue brackets 312 provided with a plurality of square through holes described in greater detail below. In various embodiments, the body segment 336 of the tongue 350 is coupled to the pair of tongue brackets 312 by at least two carriage bolts 334 and the body segment 308 of the horizontal axle 348 is coupled to the pair of tongue brackets 312 by at least two carriage bolts 310, 314. In many embodiments, the first end segment 306 of the horizontal axle 348 may be coupled to a first wheel segment 302 using a first pair of wheel brackets 348 provided with a plurality of square through holes described in greater detail below. In several embodiments, the first end segment 306 of the horizontal axle 348 is coupled to the first pair of wheel brackets 348 by at least two carriage bolts 344, 342 and the first wheel segment 302 is coupled to the first pair of wheel brackets 348 by at least two carriage bolts 346. In various embodiments, the second end segment 318 of the horizontal axle 348 is coupled to the second pair of wheel brackets 326 by at least two carriage bolts 328, 324 and the second wheel segment 320 is coupled to the second pair of wheel brackets 328 by at least two carriage bolts 322. The orientation of the first pair of wheel brackets 348 and the second pair of wheel brackets 326 may be adjusted to selectively set wheel camber as discussed in greater detail below. In many embodiments, the first wheel segment 302 is coupled to a first bearing supported axle 304 and the second wheel segment 320 is coupled to a second bearing supported axle 316. The first bearing supported axle 304 and the second bearing supported axle 316 may be removed and inserted into a plurality of holes 352, 354 defined through the first wheel segment 302 and the second wheel segment 320 respectively. Thus, the first bearing supported axle 304 and the second bearing supported axle 304 may readily change height to accommodate different size wheels. In several embodiments, the first pair of wheel brackets 348 and the second pair of wheel brackets 326 may be may be oriented downward to increase wheelchair seat height and accommodate more wheel sizes. In the illustrated embodiment, the first pair of wheel brackets 348 and the second pair of wheel brackets 326 are oriented upward.

Figure 3B:
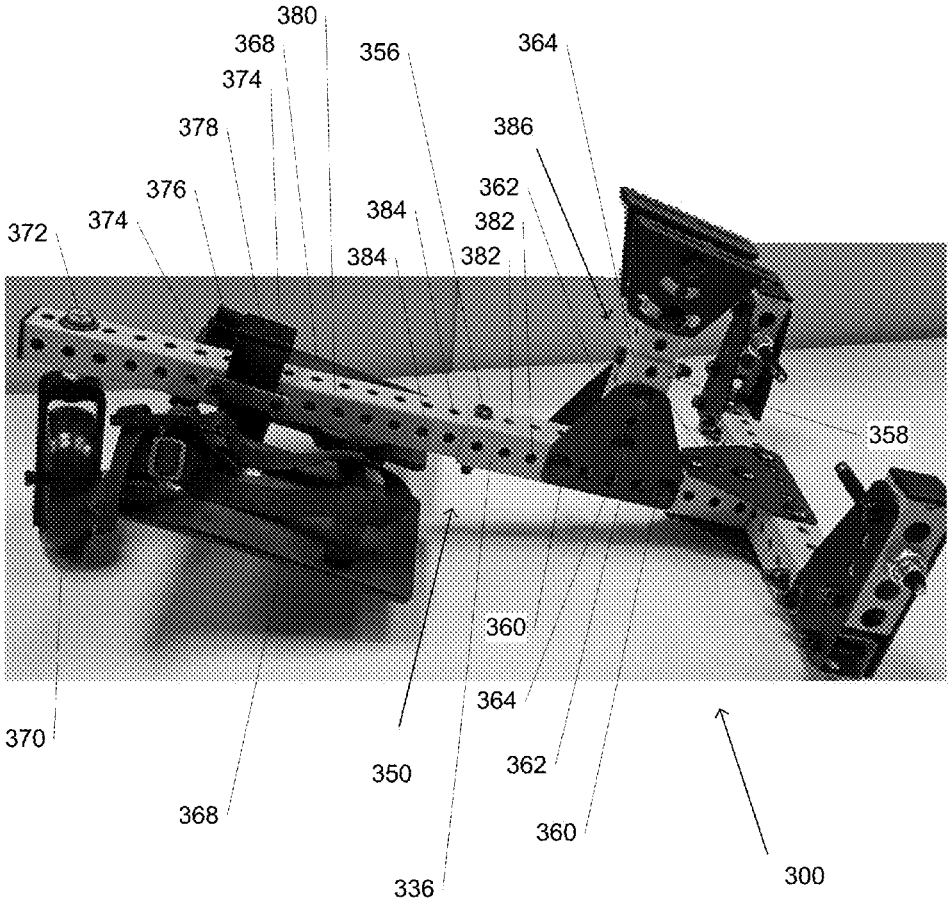
FIG. 3B is a front perspective view of an undercarriage of a wheelchair in accordance with an embodiment of the invention.

In many embodiments, a wheelchair includes an adjustable tongue of an undercarriage to accommodate a range of patients, wheelchair configurations, and wheelchair accessories. A front perspective view of an undercarriage of a wheelchair in accordance with an embodiment of the invention is illustrated in FIG. 3B. In several embodiments, the undercarriage 300 includes a tongue 350 having an end segment 380 telescopically coupled to a body segment 336 using a tongue bolt 356 that extends through opposing mutually aligned through holes in both the end segment 380 and the body segment 336. In the illustrated embodiment, the end segment 380 and the body segment 336 have a plurality of oppositely aligned, uniform through holes 384, 382 defined through all four sides along each of the segments. Thus, a patient may selectively adjust and lock the length of the wheelchair by sliding the end segment 380 towards or away from the body segment 336 before locking the wheelchair length using the tongue bolt 356. In various embodiments, a body segment 358 of a seat post 386 may be coupled to the body segment 336 of the tongue 350 using a pair of seat post brackets 362 provided with a plurality of square through holes described in greater detail below. In many embodiments, the body segment 336 of the tongue 350 is coupled to the pair of seat post brackets 362 by at least two carriage bolts 360 and the body segment 358 of the seat post 386 is coupled to the pair of seat post brackets brackets 362 by at least two carriage bolts 364. The orientation of the pair of seat post brackets 362 may be adjusted to selectively set seat post tilt as discussed in greater detail below. In several embodiments, a stirrup attachment 378 is bolted to a pair of stirrups 368. In various embodiments, the stirrup attachment 378 is coupled to the tongue by a pair of nut plates 376 (only one is visible in FIG. 3B) bolted to the tongue 350 using at least two bolts 374. Depending on which hole is selectively chosen from the plurality of oppositely aligned, uniform through holes 384, 382 of the tongue 350, the pair of stirrups 368 may be shifted along the tongue 350. In many embodiments, a swivel wheel 370 is coupled to the tongue using a bolt 372. Depending on which hole is selectively chosen from the plurality of oppositely aligned, uniform through holes 384, 382 of the tongue, the swivel wheel 370 may be shifted along the tongue 350.

Figure 3C:
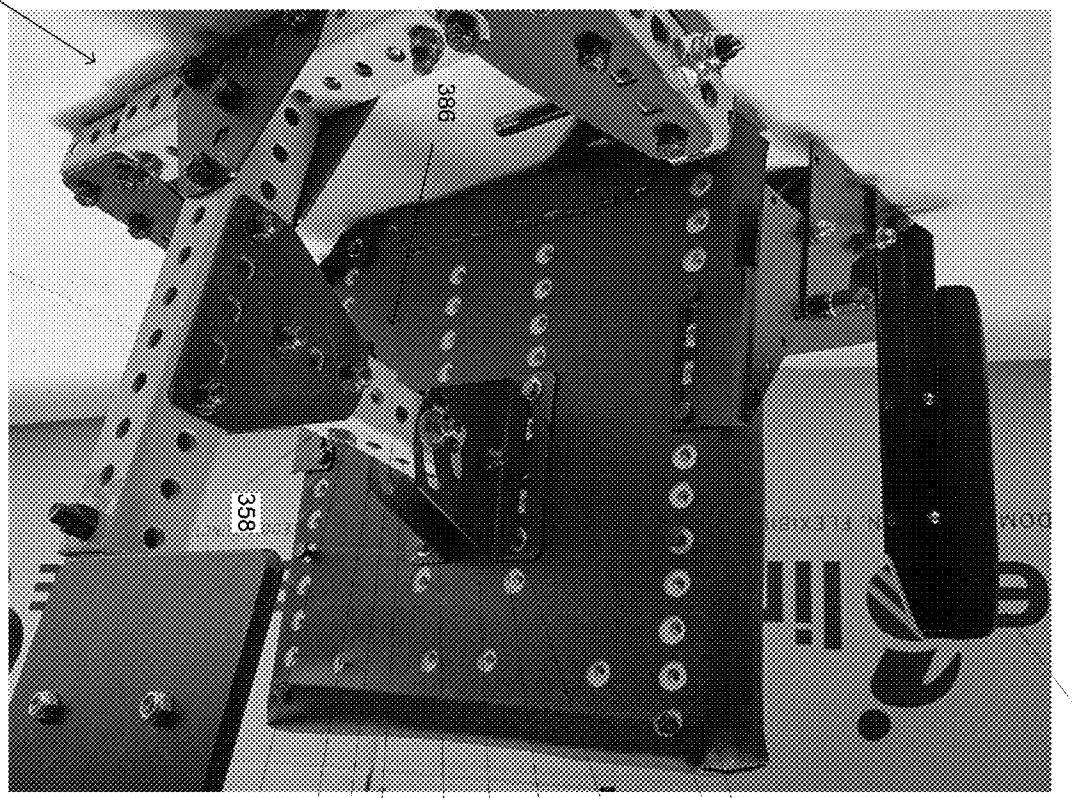
FIG. 3C is a bottom perspective view of a wheelchair in accordance with an embodiment of the invention.

In many embodiments, a wheelchair includes an adjustable seat post of an undercarriage to accommodate a range of patients and wheelchair configurations. A bottom perspective view of a wheelchair 388 in accordance with an embodiment of the invention is illustrated in FIG. 3C. In several embodiments, the undercarriage 300 includes a seat post 386 having an end segment 399 telescopically coupled to a body segment 358 using a seat post bolt 397 that extends through opposing mutually aligned through holes in both the end segment 399 and the body segment 358. In the illustrated embodiment, the end segment 399 and the body segment 358 have a plurality of oppositely aligned, uniform through holes 398 defined through all four sides along each of the segments. Thus, a patient may selectively adjust and lock the seat height of the wheelchair by sliding the end segment 399 towards or away from the body segment 358 before locking the wheelchair length using the seat post bolt 397. In various embodiments, the end segment 399 of the seat post 386 may be coupled to a seat bottom 390 using a pair of rotatable seat brackets 396 provided with a plurality of slots described in greater detail below. In many embodiments, the end segment 399 of the seat post 386 is coupled to the pair of rotatable seat brackets 396 by at least one bolt 394 and the seat bottom 390 is coupled to the pair of rotatable seat brackets 396 by at least two bolts 392 for each rotatable seat bracket (only one set of bolts is visible in FIG. 3C). The orientation of the pair of rotatable seat brackets 396 may be adjusted to selectively set seat bottom tilt as discussed in greater detail below. One skilled in the art may appreciate that the wheelchair 388 in the illustrated embodiment is assembled without any welding, but by bolting together segments with various brackets or other segments using bolts. Assembly requires only simple tools such that unskilled workers in the third world assembly sites can quickly and easily assemble operable wheelchairs. In fact, the very disable patients for whom wheelchair 100 may be intended may easily be employed in many cases as the assembly workforce.

Although specific adjustable undercarriages including a seat post, a tongue, and a horizontal axle are discussed above with respect to FIGS. 3A-3C, any variety of undercarriages incorporating a plurality of telescopically coupled segments and a plurality of brackets may be used in accordance with embodiments of the invention including additional telescopically coupled segments coupled to other segments by a bolt and additional telescopically coupled segments coupled to other segments at various angles by a plurality of brackets at various locations on the wheelchair. The wheelchair may also have an adjustable seat bottom connection in accordance with embodiments of the invention discussed further below.

Wheelchair with Adjustable Seat Bottom Connection

Figure 4:
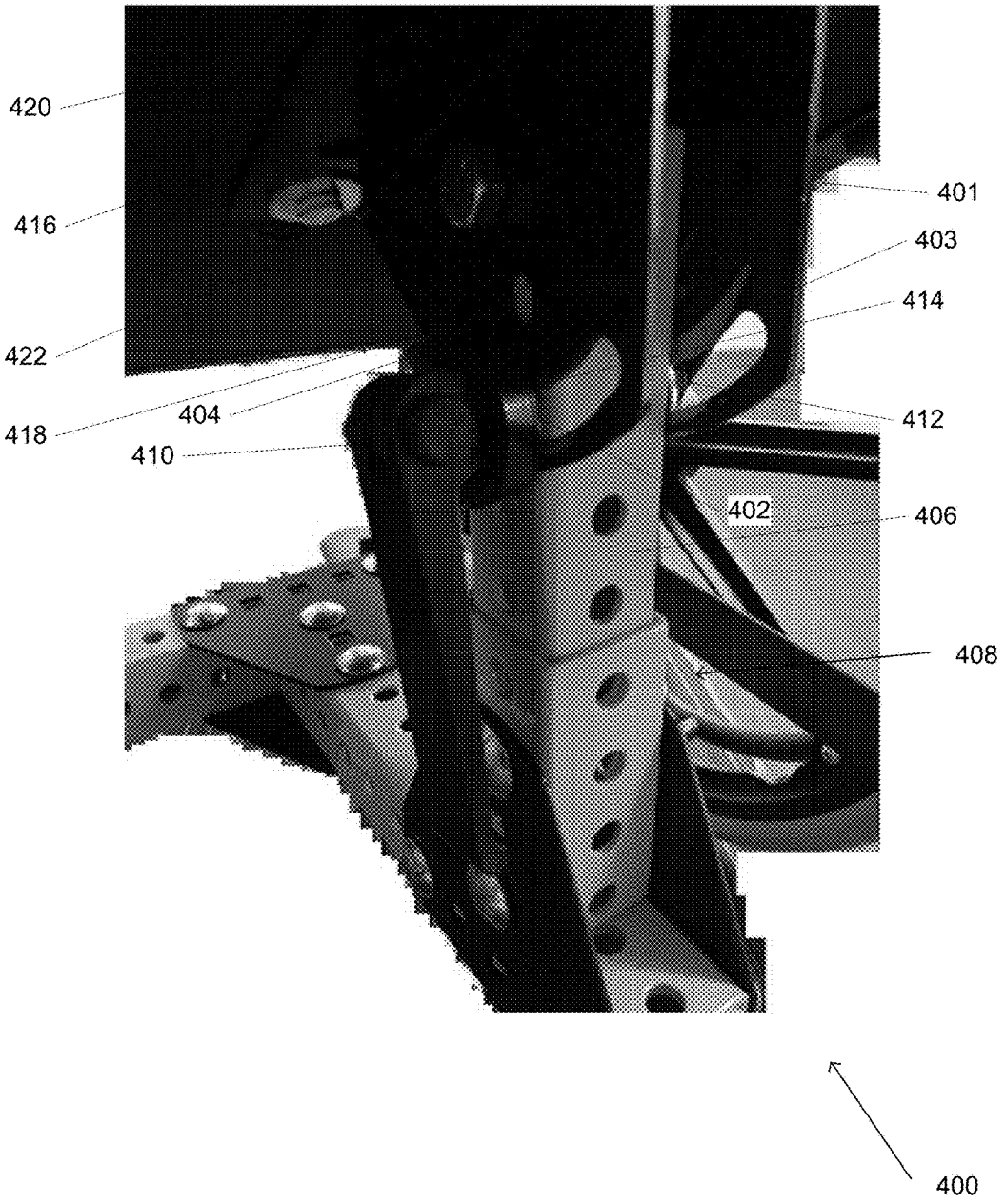
FIG. 4 is a close up view in magnified scale of a portion of the seat post of an undercarriage and its adjustable connection to a seat bottom in accordance with an embodiment of the invention.

Typically, wheelchairs with a tilt-in-space mechanism for a seat bottom include a connection allowing patients selectively lock and unlock a desired tilt. A close up view in magnified scale of a portion of the seat post of the undercarriage and its adjustable connection to the seat bottom in accordance with an embodiment of the invention is illustrated in FIG. 4. In many embodiments, a wheelchair 400 includes a pair of rotatable seat brackets including both a first rotatable seat bracket 404 and a second rotatable seat bracket 401 pivotally coupled to an end segment 406 of a seat post 408. In several embodiments, the angular orientation of the pair of rotatable seat brackets 404, 401 is selectively chosen and locked into place using a cam lever 410, which compresses a washer stack 402 on a bolt 412 disposed through the end segment 406 of the seat post 408 and through an arcuate slot 414 defined in a first end portion 420, 403 for each bracket in the pair of rotatable seat brackets 404, 401. In various embodiments, a second end portion 416 (one of which is not visible in FIG. 4) for each bracket in the pair of rotatable seat brackets 404, 401 is bolted to the seat bottom 420. Thus, it can be understood by one of ordinary skill that the angular orientation of the seat bottom 420 relative to the pair of rotatable seat brackets 404 can be set at as many different angular orientations as the arcuate slot 414 will allow. In the illustrated embodiment, the seat bottom 420 may be tilted up to 70° forward or backward relative to the seat post 408. In many embodiments, the seat bottom 420 may be inclined to a vertical position by removing the bolt 412 or a bolt 422 and rotating the seat bottom 420 90° about the pair rotatable seat brackets.

Although specific wheelchairs with an adjustable seat bottom connection are discussed above with respect to FIG. 4, any variety of wheelchairs incorporating an adjustable seat bottom connection may be used in accordance with embodiments of the invention. The wheelchair may also include several brackets in accordance with embodiments of the invention discussed further below.

Brackets

Figure 5:
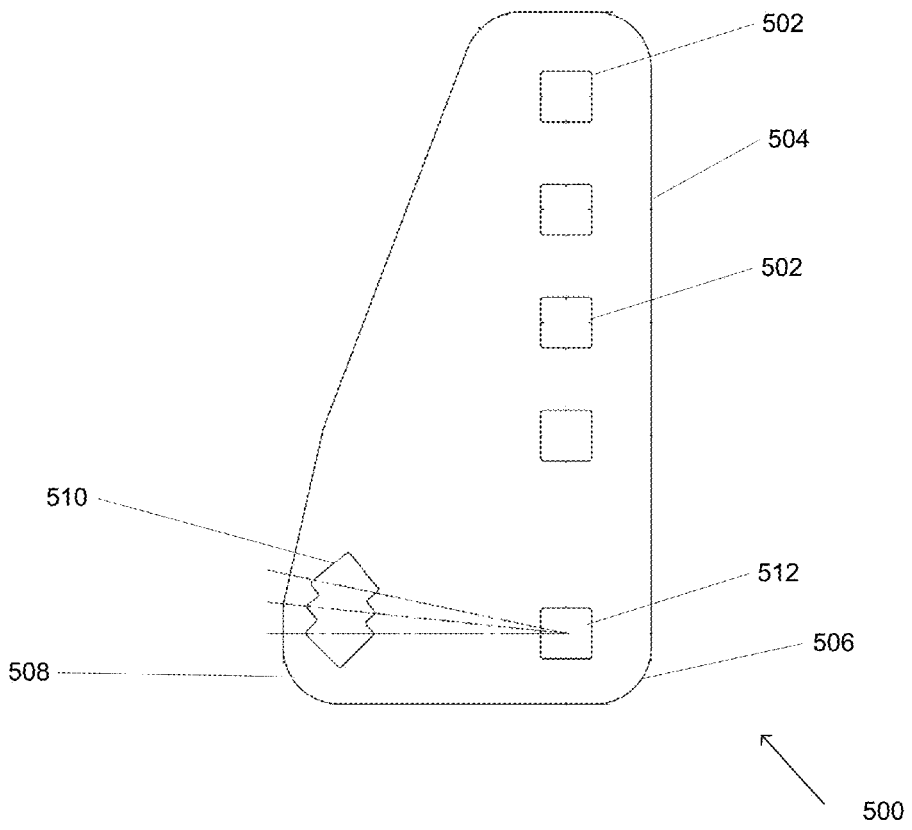
FIG. 5 is a schematic diagram illustrating of a wheel bracket in accordance with an embodiment of the invention.

Typically, wheelchairs for ready assembly without welding have a variety of brackets used to connect wheelchair components. A schematic diagram of a wheel bracket in accordance with an embodiment of the invention is illustrated in FIG. 5. In many embodiments, a wheel bracket 500 includes a plurality of square holes 502 defined along a rear vertical edge 504 of the wheel bracket 500. In several embodiments, the wheel bracket 500 further includes a lower outboard corner 506 having a square hole 512 and an opposing inboard corner 508 having a plurality of interconnected and overlapping square holes 510 defined therethrough. Thus, it can be understood by one of ordinary skill that the angular orientation of the wheel bracket 500 can be set at as many different angular orientations as the plurality of interconnected and overlapping square holes 510 will allow by selecting one of the plurality of interconnected and overlapping square holes 510 for receipt of a carriage bolt (not visible in FIG. 5). In the illustrated embodiment, three different angular orientations are allowed. In various embodiments, the camber of a corresponding wheel can be selectively determined and fixed based on the selected angular orientation of the wheel bracket 500. Cambered wheels are known to improve wheelchair-handling characteristics and stability. As camber is increased, the width of the wheelchair across the bottom increases. This adds lateral stability to the system by increasing the wheelchair footprint. If too much camber is added there may be a problem getting through doorways. The amount of camber required for daily use is not commonly the same as that which is required for sports. Camber has the following advantages: the wider footprint adds lateral stability to the wheelchair; redirects forces to soften the ride; places the push rims in a more ergonomic position for pushing; it is more natural to push down and outward; protects the hands when pushing in tight areas since the bottom of the wheel will make contact first with walls and doorframes; less strain on the shoulders since the plane of the wheel is closer to that of the shoulder; makes turning quicker; and gives the wheelchair a sportier look.

Figure 6:
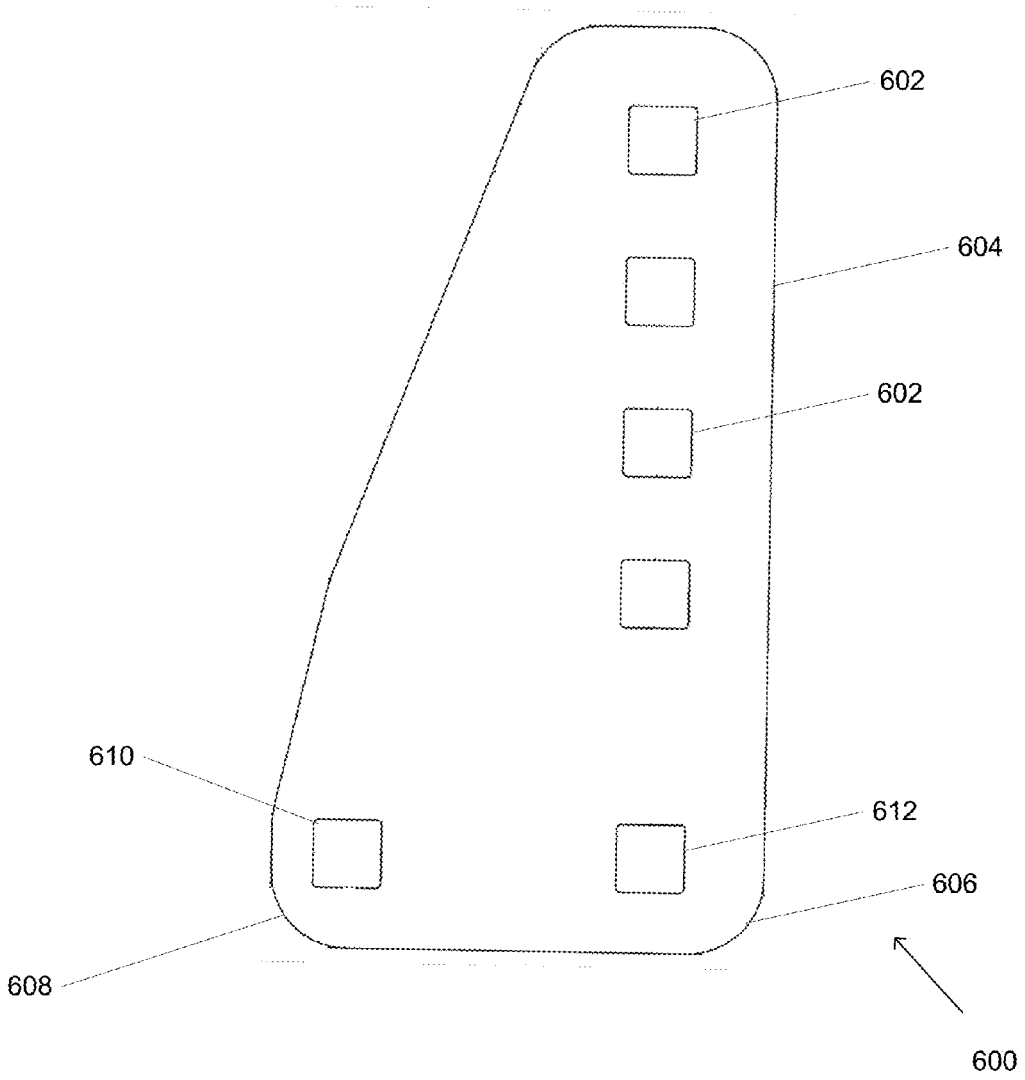
FIG. 6 is a schematic diagram illustrating of a wheel bracket in accordance with an embodiment of the invention.

In many embodiments, adjustability of wheel camber may not be desired. A schematic diagram of another wheel bracket in accordance with an embodiment of the invention is illustrated in FIG. 6. In several embodiments, a wheel bracket 600 includes a plurality of square holes 602 defined along a rear vertical edge 604 of the wheel bracket 600. In various embodiments, the wheel bracket 600 further includes a lower outboard corner 606 having a first square hole 612 and an opposing inboard corner 608 having a second square hole 610 defined therethrough. In the illustrated embodiment, the center of the first square hole 612 aligns with the center of second square hole 610 at an angle perpendicular to the rear vertical edge 604. Thus, it can be understood by one of ordinary skill that selecting the second square hole 610 for receipt of a carriage bolt (not visible in FIG. 6) introduces no wheel camber.

Figure 7A:
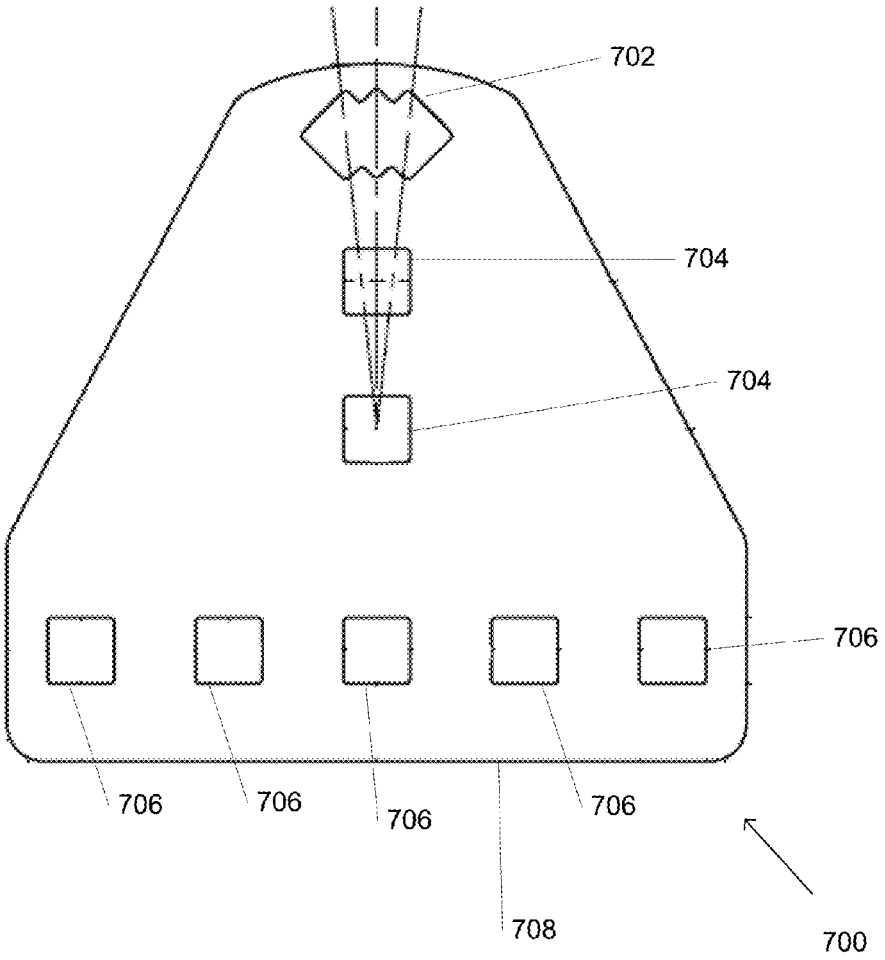
FIG. 7A is a schematic diagram illustrating of a seat post bracket in accordance with an embodiment of the invention.
Figure 7B:
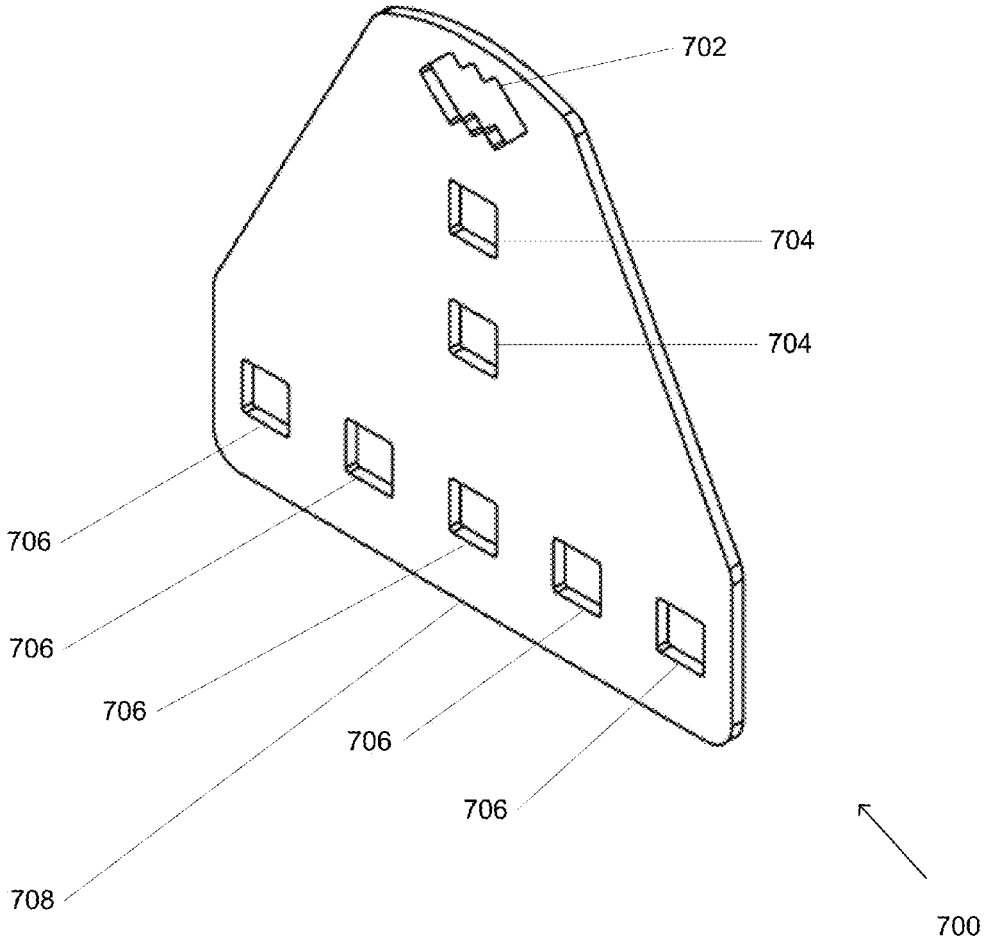
FIG. 7B is a front perspective view of the seat post bracket of FIG. 7A in accordance with an embodiment of the invention.

In several embodiments, a wheelchair includes a seat post bracket for coupling a tongue to a seat post. A schematic diagram of a seat post bracket in accordance with an embodiment of the invention is illustrated in FIG. 7A and FIG. 7B. In various embodiments, a seat post bracket 700 includes a first plurality of square holes 706 defined through the seat post bracket 700 along a lower edge 708 for use in coupling to a body segment of a tongue (not visible in FIG. 7A or FIG. 7B). In many embodiments, the seat post bracket 700 includes a second plurality of square holes 704 defined through the seat post bracket 700 and a plurality of interconnected and overlapping square holes 702 defined through the seat post bracket 700 for use in coupling to a body segment of a seat post (not visible in FIG. 7A or FIG. 7B). Thus, it can be understood by one of ordinary skill that the seat post bracket 700 can couple a body segment of a seat post set to as many angular orientations as the plurality of interconnected and overlapping square holes 702 will allow.

In the illustrated embodiment, three different angular orientation are allowed. Depending on which one of the plurality of interconnected and overlapping square holes 702 is chosen for receipt of a carriage bolt, a seat post may be tilted forward or rearward in accordance with embodiments of the invention.

Figure 8:
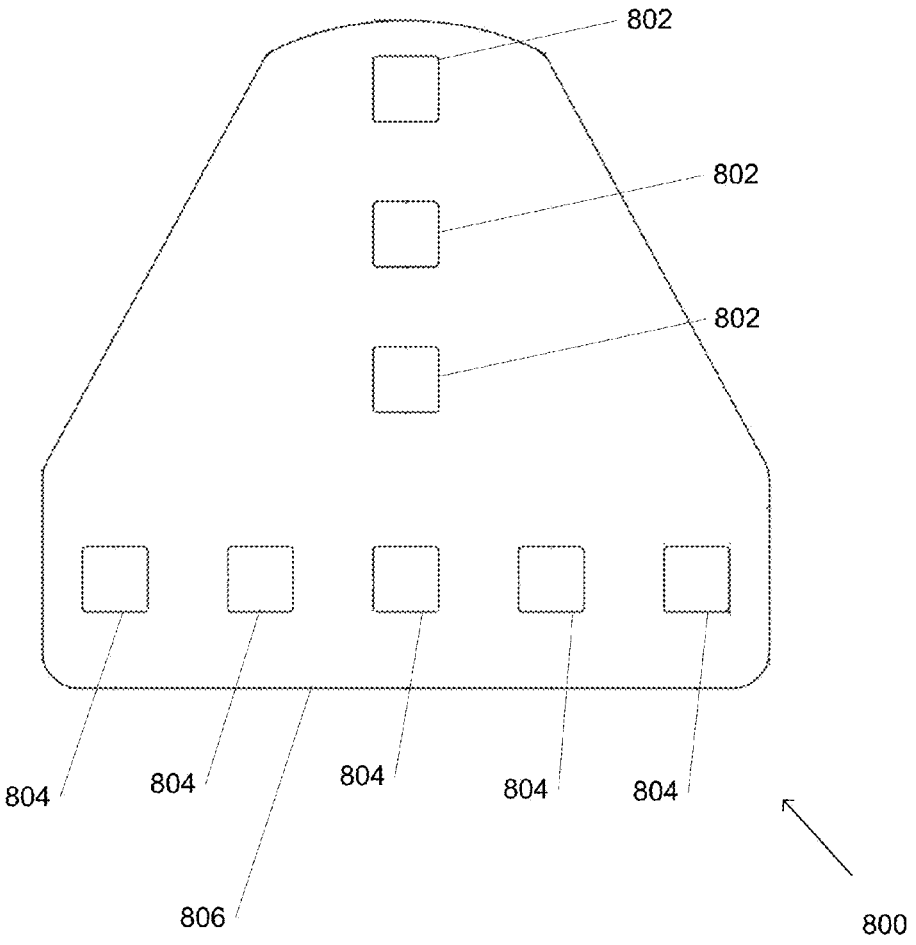
FIG. 8 is a schematic of a tongue bracket in accordance with an embodiment of the invention.

In many embodiments, a wheelchair includes a tongue bracket for coupling a tongue to a horizontal axle. A schematic of a tongue bracket in accordance with an embodiment of the invention is illustrated in FIG. 8. In several embodiments, a tongue bracket 800 includes a first plurality of square holes 804 defined through the tongue bracket 800 along a lower edge 806 for use in coupling to a body segment of a horizontal axle (not visible in FIG. 8). In various embodiments, the tongue bracket 800 includes a second plurality of square holes 802 defined through the tongue bracket 800 for use in coupling to a body segment of a tongue (not visible in FIG. 8).

Figure 9A:
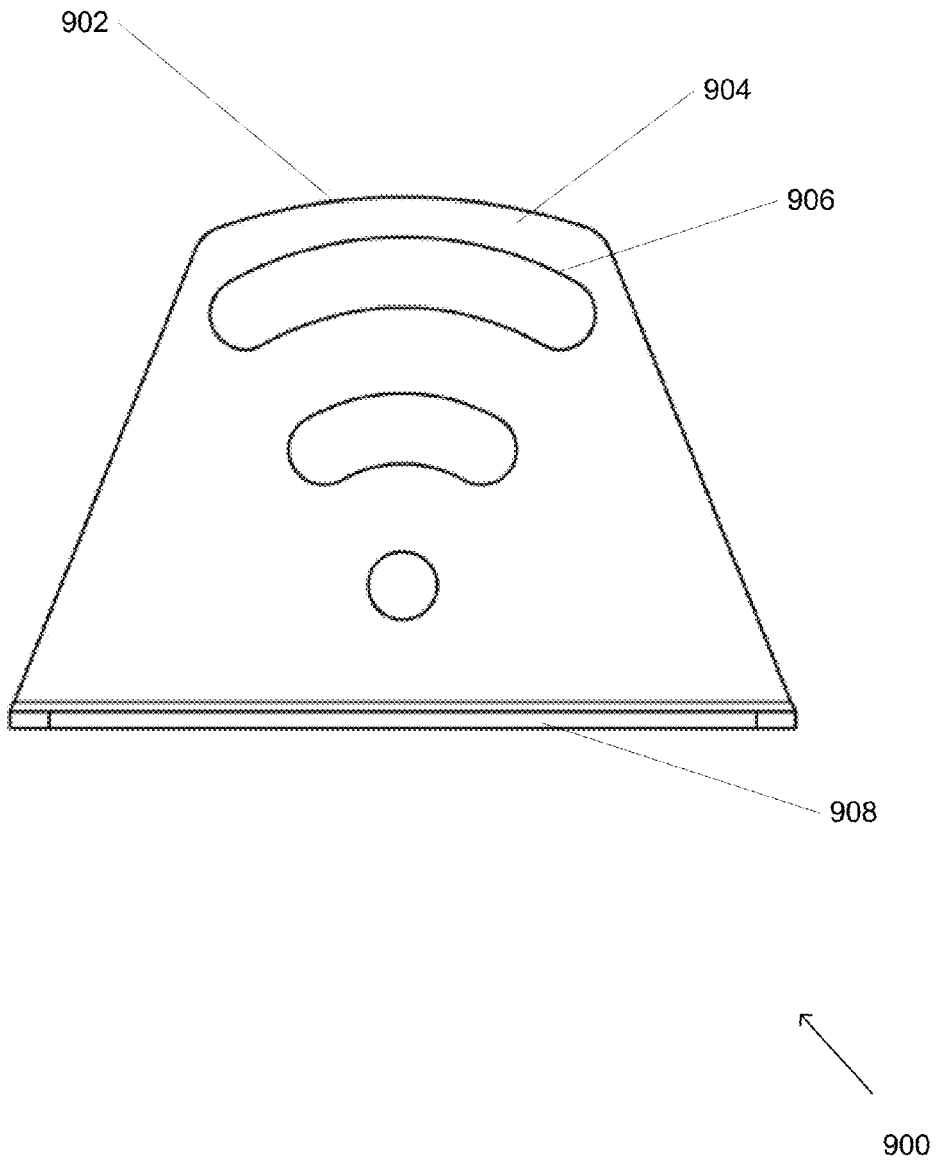
FIG. 9A is a schematic of a rotatable seat bracket in accordance with an embodiment of the invention.
Figure 9B:
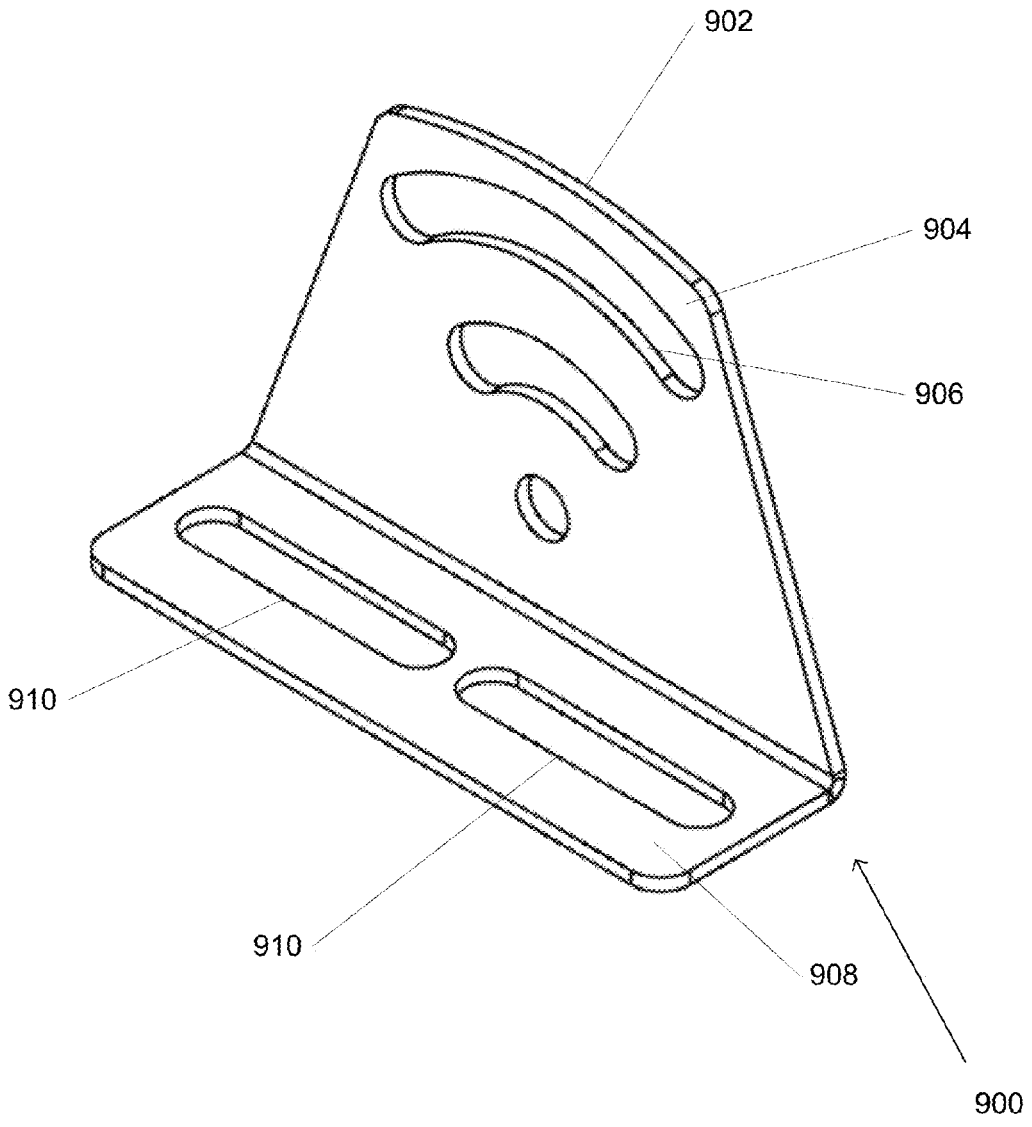
FIG. 9B is a front perspective view of the rotatable seat bracket of FIG. 9A in accordance with an embodiment of the invention.

In many embodiments, a wheelchair includes a rotatable seat bracket for coupling a seat bottom to a seat post. A schematic diagram of a rotatable seat bracket in accordance with an embodiment of the invention is illustrated in FIG. 9A and FIG. 9B. In several embodiments, a rotatable seat bracket 900 includes a second end portion 908 having a plurality of slots 910 (visible in FIG. 9B) defined through the rotatable seat bracket 900 for use in coupling to a seat bottom (not visible in FIG. 9A or FIG. 9B). In various embodiments, the rotatable seat bracket 900 includes a first end portion 904 having an arcuate slot 906 defined through the rotatable seat bracket 900 along a lower edge 902 for use in coupling to an end segment of a seat post (not visible in FIG. 9A or FIG. 9B). It can be understood by one of ordinary skill that the angular orientation of the seat bottom relative to the rotatable seat bracket 900 can be set at as many different angular orientations as the arcuate slot 906 will allow depending on an adjustable seat bottom connection discussed above.

Figure 10A:
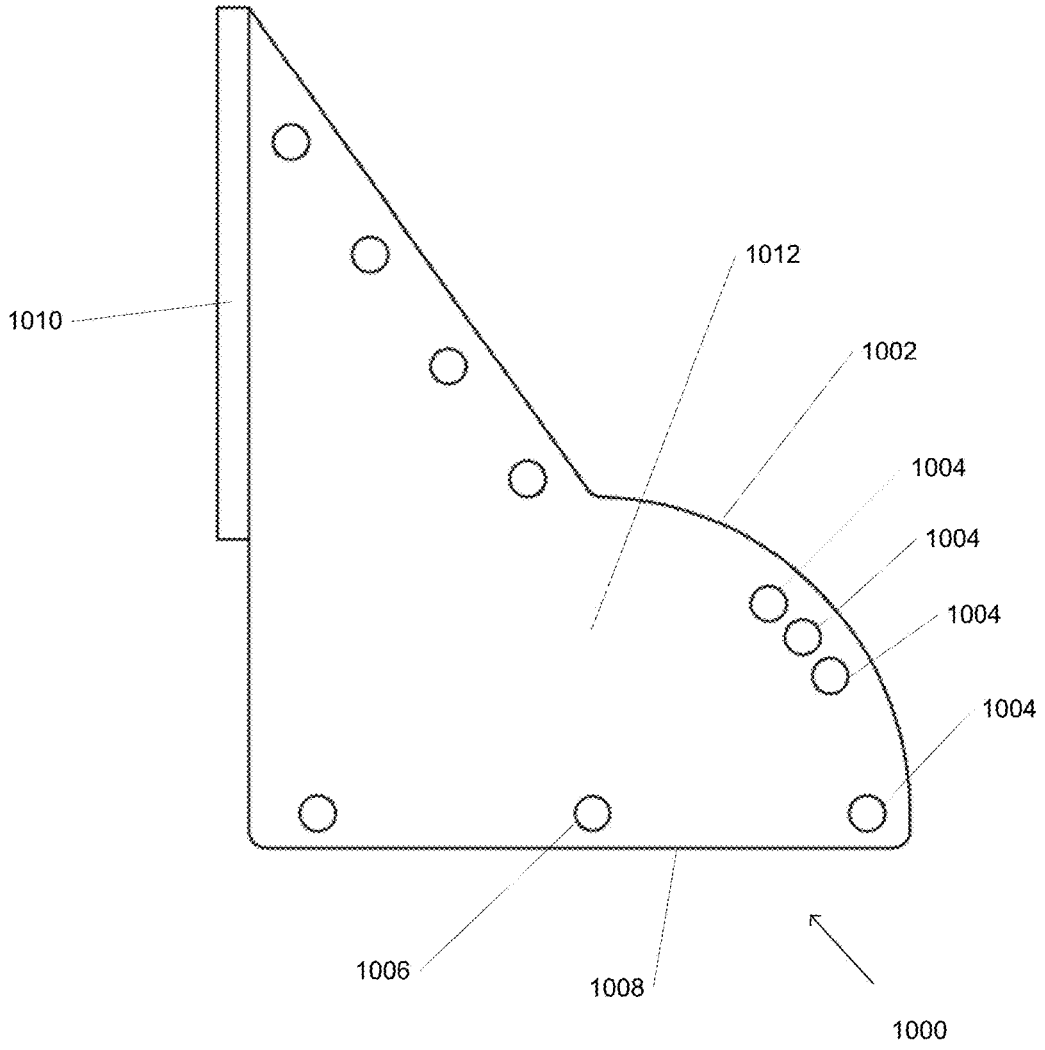
FIG. 10A is a schematic of a first rotatable portion of a locking hinge bracket in accordance with an embodiment of the invention.
Figure 10B:
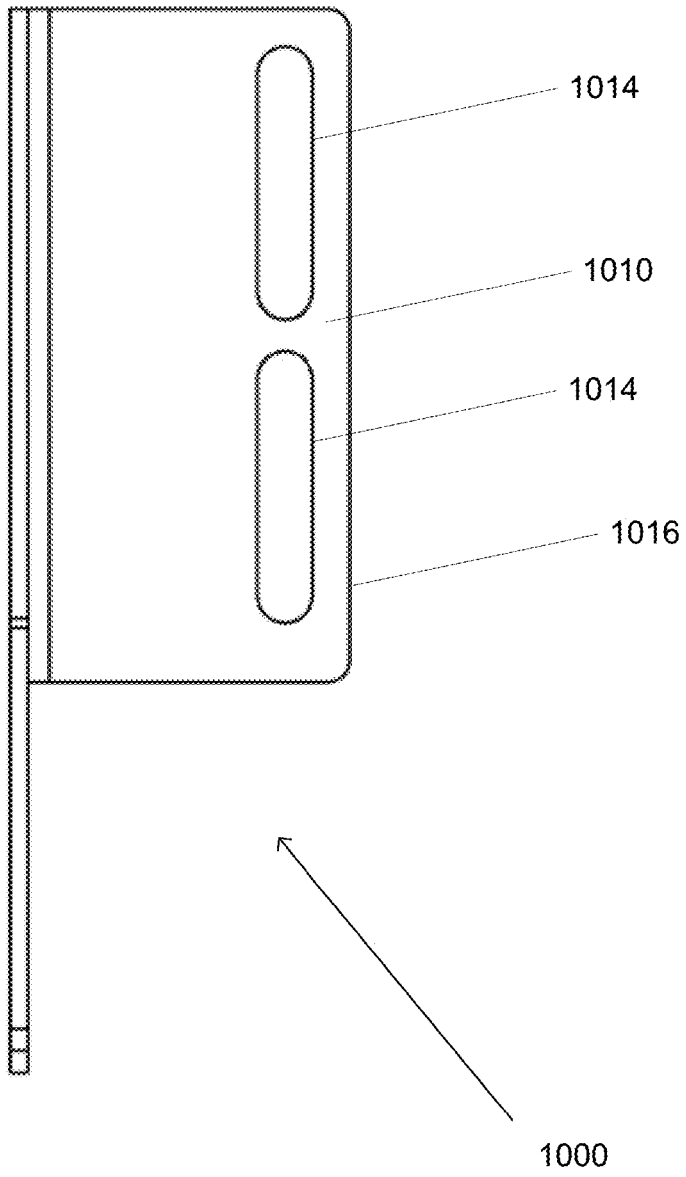
FIG. 10B is a side view of the first rotatable portion of the locking hinge bracket of FIG. 10A in accordance with an embodiment of the invention.

In many embodiments, a wheelchair includes a locking hinge bracket for coupling a seat bottom to a seatback. A schematic diagram of a first rotatable portion of a locking hinge bracket in accordance with an embodiment of the invention is illustrated in FIG. 10A and FIG. 10B. In several embodiments, a first rotatable portion 1000 includes a second end portion 1010 having a plurality of slots 1014 (visible in FIG. 10B) defined through the second end portion along an edge 1016 for use in coupling to a seat bottom (visible in FIG. 3C). In various embodiments, the first rotatable portion 1000 including a first end portion 1012 having a first hole 1006 defined through the first end portion 1000 along a lower edge 1008 for receipt of a bolt to couple the first hole 1006 to a similarly situated second hole defined through a second rotatable portion of the locking hinge bracket (second rotatable portion visible in FIGS. 2A, 2B, and 3C). In various embodiments, the first end portion 1012 includes a plurality of holes 1004 defined through the first end portion 1012 along a curved edge 1002 for use in coupling to the second rotatable portion. Thus, it can be understood by one of ordinary skill that the angular orientation of the first rotatable portion 1000 can be set at as many different angular orientations as the plurality of holes 1004 will allow by selecting one of the plurality holes 1004 for receipt of a bolt coupling the first rotatable portion of the locking hinge bracket to the second rotatable portion of the locking hinge bracket (visible in FIGS. 2A, 2B, and 3C). In the illustrated embodiment, four different angular orientations are allowed. Depending on which one of the plurality of holes 1004 is chosen for receipt of a bolt, the locking hinge bracket may align a seat bottom to a seatback or fold the seat bottom towards the seatback.

Figure 11:
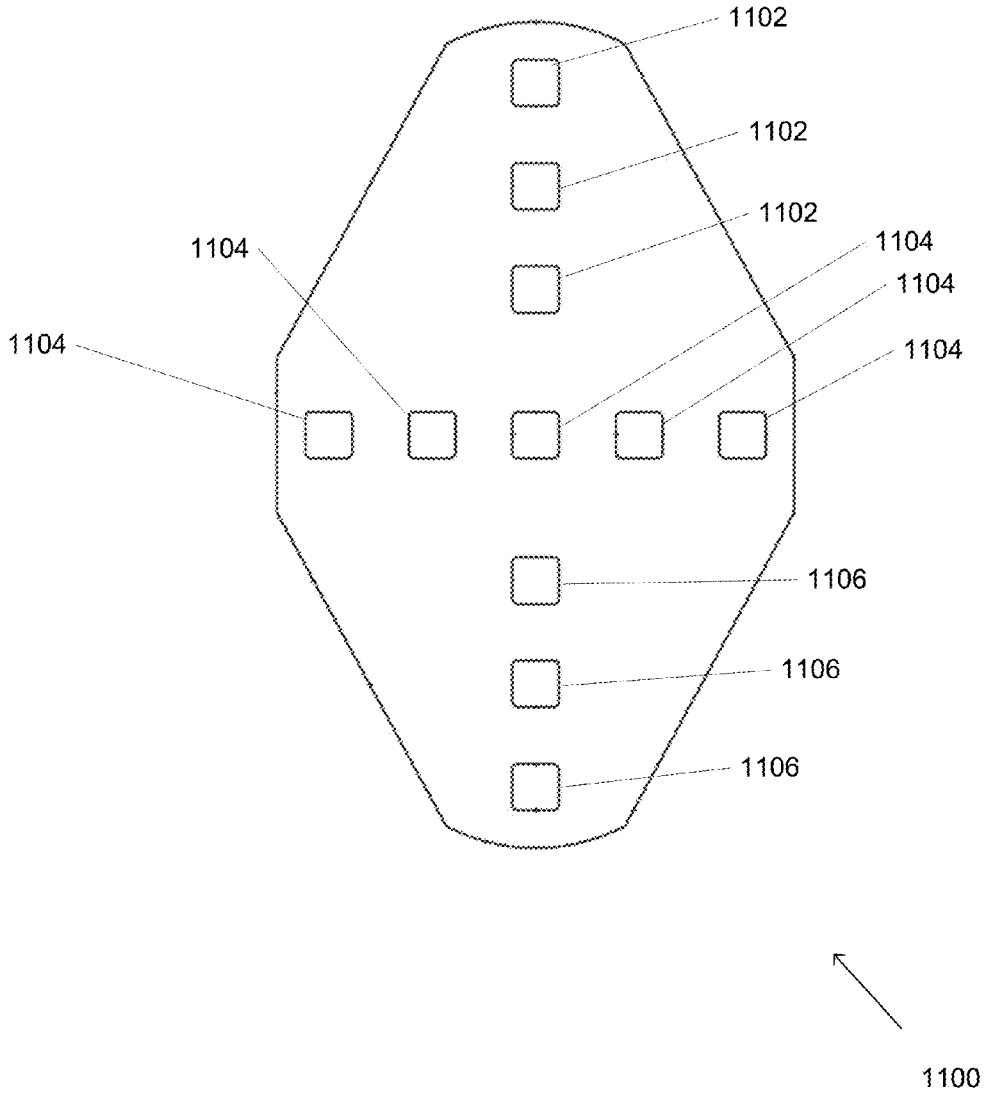
FIG. 11 is a schematic diagram illustrating of an extension bracket in accordance with an embodiment of the invention.

In many embodiments, a wheelchair includes an extension bracket for coupling an additional tongue to a horizontal axle of an undercarriage. A schematic of an extension bracket in accordance with an embodiment of the invention is illustrated in FIG. 11. In several embodiments, an extension bracket 1100 includes a first plurality of square holes 1104 defined through the extension bracket 1100 for use in coupling to a body segment of a horizontal axle (not visible in FIG. 11). In various embodiments, the extension bracket 1100 includes a second plurality of holes 1102 defined through the extension bracket 1100 between the first plurality of square holes 1104 and a first corner 1108 for use in coupling to a first tongue segment (not visible in FIG. 11). In many embodiments, the extension bracket 1100 includes a third plurality of holes 1106 defined through the extension bracket 1100 between the first plurality of square holes 1104 and a second corner 1110 for use in coupling to a second tongue segment (not visible in FIG. 11). It may be understood that the second plurality of square holes 1104 and the third plurality of square holes 1106 may be misaligned with each other to couple to parallel tongues. Further, additional tongues may be added to either side of the horizontal axle by introducing additional aligned square holes defined through the extension bracket 1100 between the first plurality of square holes 1104 and the corners 1108, 1110. In the illustrated embodiment, the second plurality of square holes 1104 and the third plurality of square holes 1106 are aligned and can couple to two tongues.

Although specific brackets are discussed above with respect to FIGS. 5-11, any variety of brackets may be used in accordance with embodiments of the invention including brackets of various shapes at various locations on the wheelchair. The wheelchair may also have a tow bar in accordance with embodiments of the invention discussed further below.

Wheelchair with Tow Bar

Figure 14:
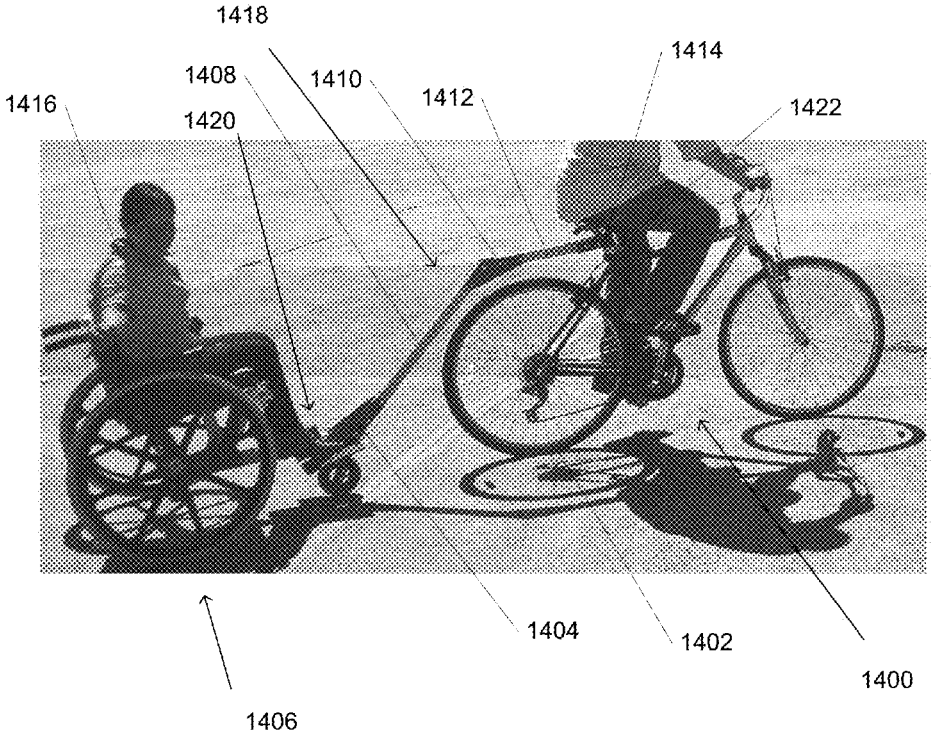
FIG. 14 is an illustration showing the coupling of a wheelchair to a bicycle to provide a rickshaw-like combination in accordance with an embodiment of the invention.

Wheelchairs in accordance with embodiments of the invention may include a tow bar to allow an attendant to conveniently tow a disabled patient in a wheelchair. A wheelchair coupled to a bicycle using a tow bar to provide a rickshaw-like combination in accordance with an embodiment of the invention is illustrated in FIG. 14. In several embodiments, a wheelchair 1406 may be coupled to a conventional bicycle 1400 to provide a rickshaw-like assembly whereby an attendant can conveniently tow a disabled person 1416 in the wheelchair 1406 over the ranges and speeds typically obtainable using the conventional bicycle 1400. In various embodiments, a bicycle tow bar 1418 includes a tongue coupling segment 1408 and a bicycle coupling segment 1412. In many embodiments, the tongue coupling segment 1408 is coupled to a tongue 1420 by means of a first pair of triangular brackets 1404. In several embodiments, the bicycle coupling segment 1412 is coupled to the tongue coupling segment 1408 by a second pair of triangular brackets 1410. In various embodiments, the bicycle coupling segment 1412 is sufficiently long and angled to extend over a rear wheel 1402 of the conventional bicycle 1400 and is rotatably coupled at its distal end to a seat post 1422 of the conventional bicycle 1400 by a flexible U-shaped strap 1414.

Figure 15:
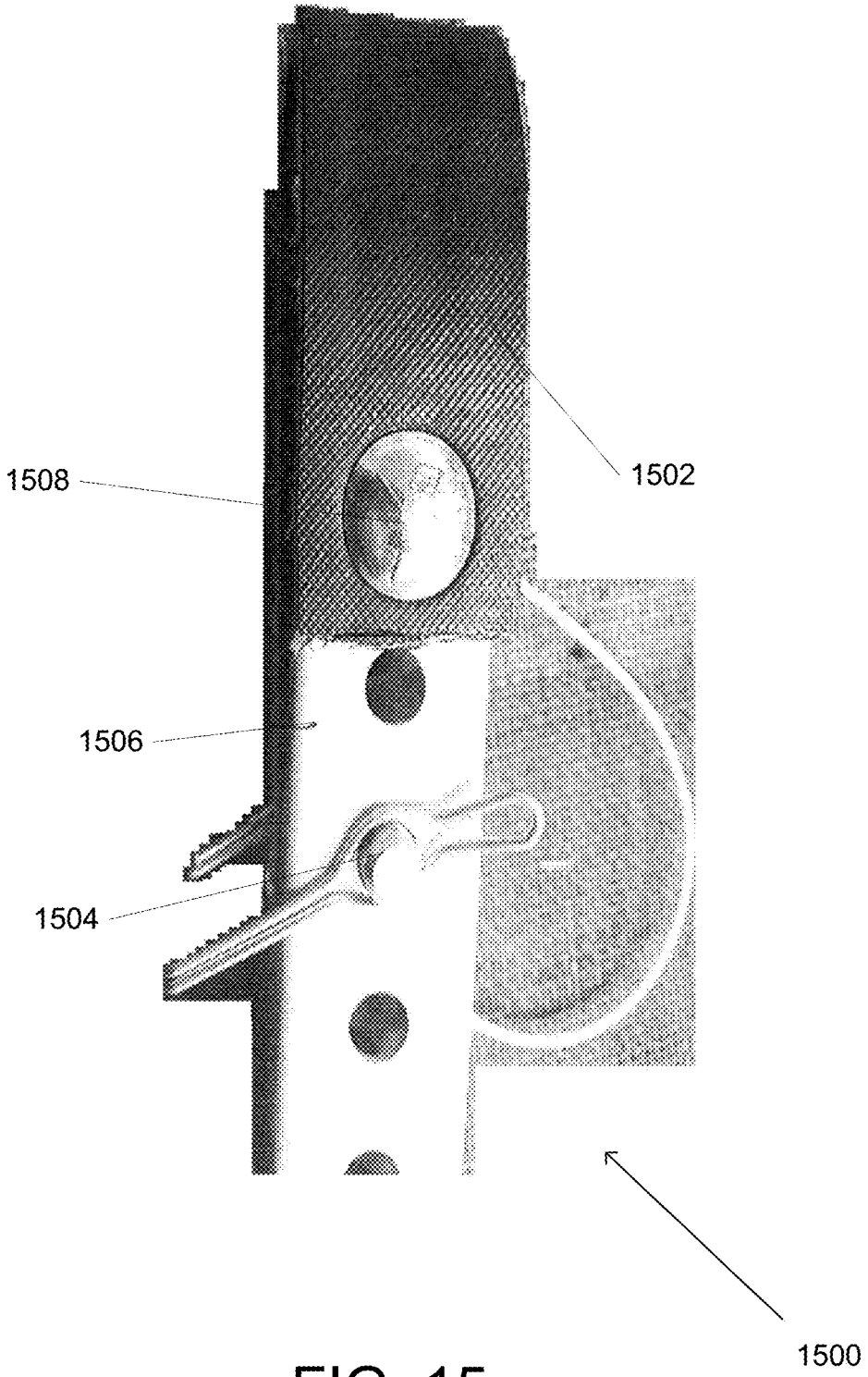
FIG. 15 is an enlarged view of a distal end of a tow bar used in FIG. 14 to rotatably couple a wheelchair to a seat post of a bicycle in accordance with an embodiment of the invention.

An enlarged view of a distal end of a tow bar used in FIG. 14 to rotatably couple the wheelchair to a seat post of the bicycle in accordance with an embodiment of the invention is illustrated in FIG. 15. In many embodiments, a distal end 1500 of a tow bar (not fully visible in FIG. 15) includes a U-shaped strap 1502 with one end coupled to one side of a bicycle coupling segment 1506 by a bolt 1508 and an opposite end coupled to an opposing side of the bicycle coupling segment 1506 by a bolt 1504 extending through opposing mutually aligned through holes between both the U-shaped strap 1502 and the bicycle coupling segment 1506.

Although specific wheelchairs and specific tow bars are discussed above with respect to FIG. 14 and FIG. 15, any variety of wheelchairs and tow bars may be used in accordance with embodiments of the invention. The wheelchair may also have a hand crank driven front wheel assembly in accordance with embodiments of the invention discussed further below.

Wheelchair with Hand Crank Driven Front Wheel Assembly

Figure 16:
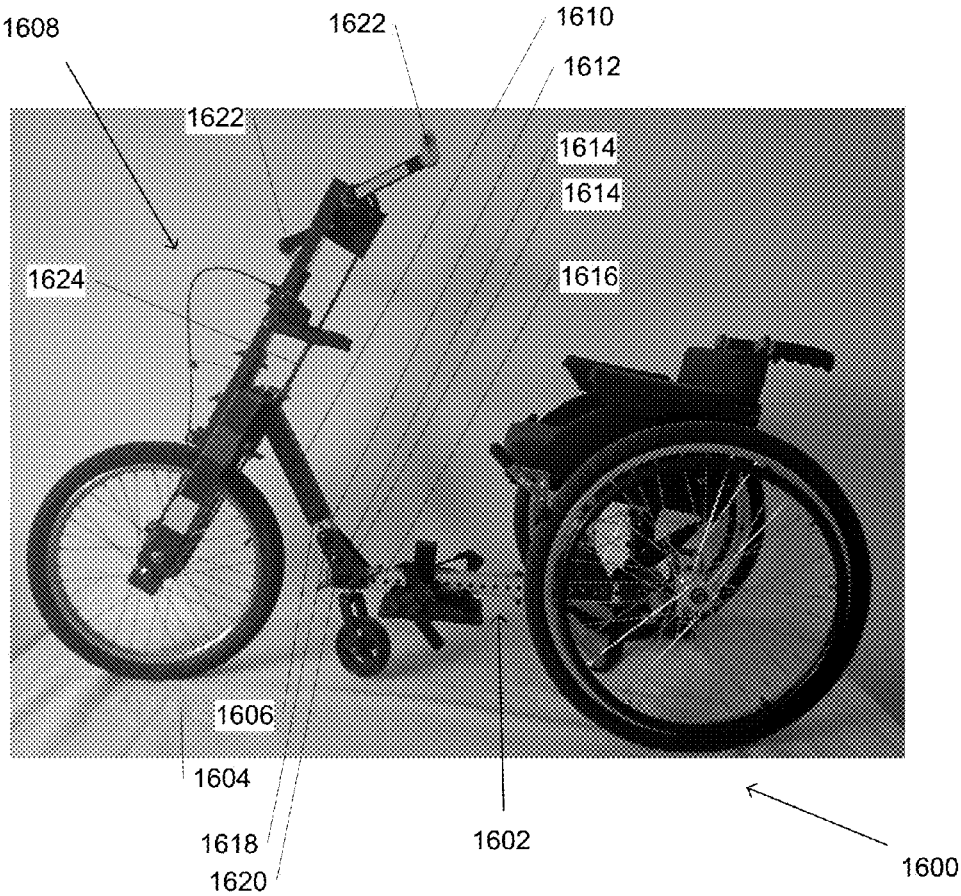
FIG. 16 is a side perspective view of a wheelchair combined with a hand cranked drive mechanism in accordance with an embodiment of the invention.

A wheelchair for weakened and/or disabled patients may include a device to help them propel and steer the wheelchair while an attendant is unavailable. A side perspective view of a wheelchair combined with a hand cranked drive mechanism in accordance with an embodiment of the invention is illustrated in FIG. 16. In many embodiments, a wheelchair 1600 includes a hand crank driven front wheel assembly 1608 is attached to a first assembly segment 1610. In several embodiments, the first assembly segment 1610 is telescopically coupled to a second assembly segment 1612 using a bolt 1606 extending through opposing mutually aligned through holes between both the first assembly segment 1610 and the second assembly segment 1612. In various embodiments, the second assembly segment 1612 is coupled to an end segment 1616 of a tongue 1602 by a pair of triangular brackets 1614 using at least two bolts 1618, 1620 extending through opposing mutually aligned through holes between both the second assembly segment 1612 and the end segment 1616 of the tongue 1602. In this manner, a disabled patient may use a pair of hand cranks 1622 coupled by a chain drive 1624 to a drive wheel 1604 of the hand crank driven front wheel assembly 1608 to propel and the steer wheelchair 1600.

Although specific wheelchairs with a hand crank driven front wheel assembly are discussed above with respect to FIG. 16, any variety of wheelchairs with a hand crank driven front wheel assembly may be used in accordance with embodiments of the invention. The wheelchair may be assembled in accordance with embodiments of the invention discussed further below.

Construction Process Utilizing Wheelchair Component Kit

Figure 17:
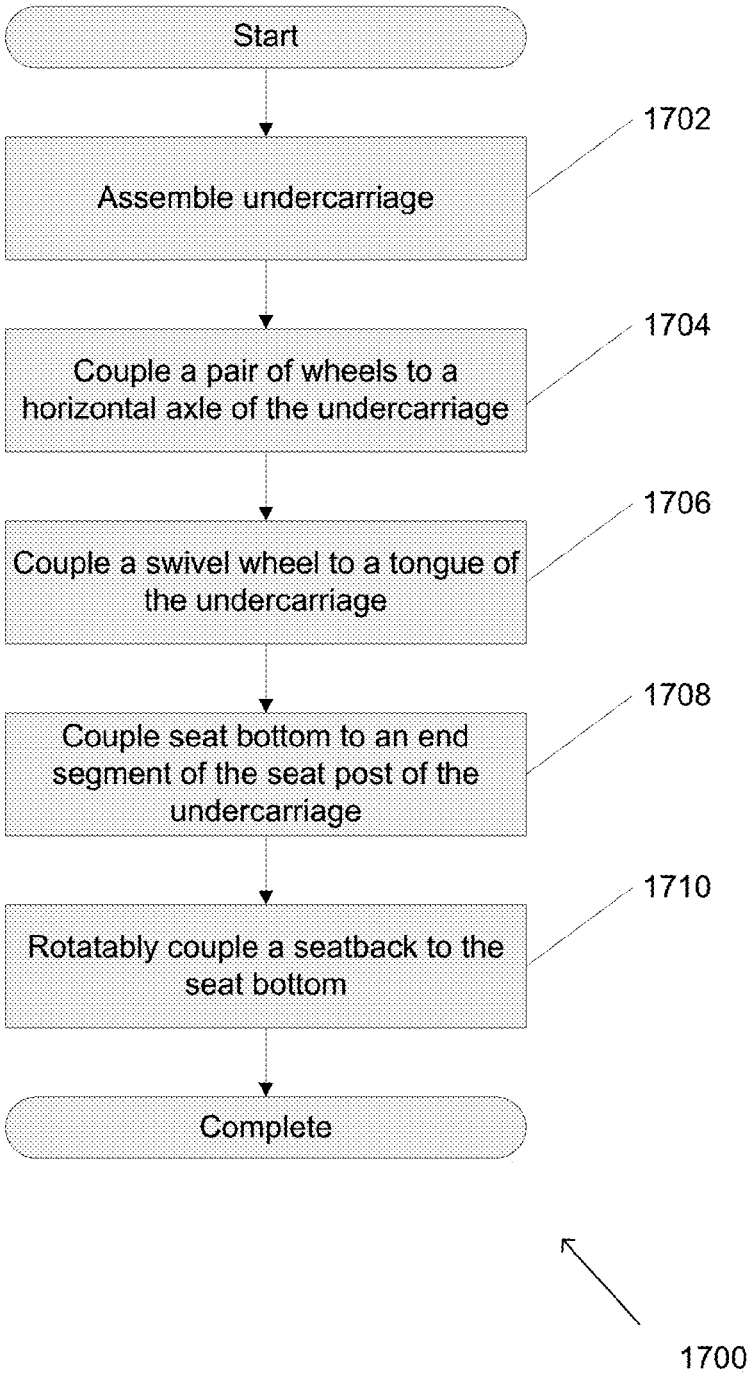
FIG. 17 is a flow chart illustrating a process of constructing a wheelchair in accordance with an embodiment of the invention.

Wheelchairs as described above may allow for ready assembly utilizing processes and methods that do not require specialized tools and/or particularly skilled labor. A flow chart illustrating a process of constructing a wheelchair in accordance with an embodiment of the invention is shown in FIG. 17. The process 1700 includes assembling (1702) an undercarriage having a seat post, a horizontal axle, and a tongue. The process also includes providing mobility for the wheelchair by coupling (1704) a pair of wheels to the horizontal axle of the undercarriage. In many embodiments, this may be accomplished by coupling a first wheel of the pair of wheels to a first wheel segment using a first bearing supported axle extending through holes defined through the first wheel segment. In several embodiments, the process may include coupling the first wheel segment to a first end segment of the horizontal axle using a first pair of wheel brackets. In various embodiments, at least two carriage bolts couple the first wheel segment to the first pair of wheel brackets and at least two carriage bolts couple the first end segment of the horizontal axle to the first pair of wheel brackets. In many embodiments, the first wheel camber may be selectively determined using a carriage bolt extending through a plurality of interconnected and overlapping square holes defined through the first pair of wheel brackets as described above. In several embodiments, the process includes coupling a second wheel of the pair of wheels to a second wheel segment using a second bearing supported axle extending through holes defined through the second wheel segment. In several embodiments, the process may include coupling the second wheel segment to a second end segment of the horizontal axle using a second pair of wheel brackets. In various embodiments, at least two carriage bolts couple the second wheel segment to the second pair of wheel brackets and at least two carriage bolts couple the second end segment of the horizontal axle to the second pair of wheel brackets. In many embodiments, the second wheel camber may be selectively determined using a carriage bolt extending through a plurality of interconnected and overlapping square holes defined through the second pair of wheel brackets as described above. The process may also include coupling (1706) a swivel wheel to the tongue of the undercarriage. The process can further include coupling (1708) a seat bottom to the seat post of the undercarriage. In several embodiments, the seat bottom may be pivotally coupled to an end segment of the seat post of the undercarriage using a pair of rotatable seat brackets in a manner described above. In various embodiments, the seat tilt may be adjusted using an adjustable seat bottom connection described above. In many embodiments, the process also includes rotatably coupling (1710) a seatback to the seat bottom using a pair of locking hinge brackets in a manner described above. In several embodiments, the pair of locking hinge brackets may align the seat bottom and the seatback to assume a horizontal position used as part of a gurney configuration or to assume a vertical position used as part of a compact storage configuration as discussed above.

Figure 18:
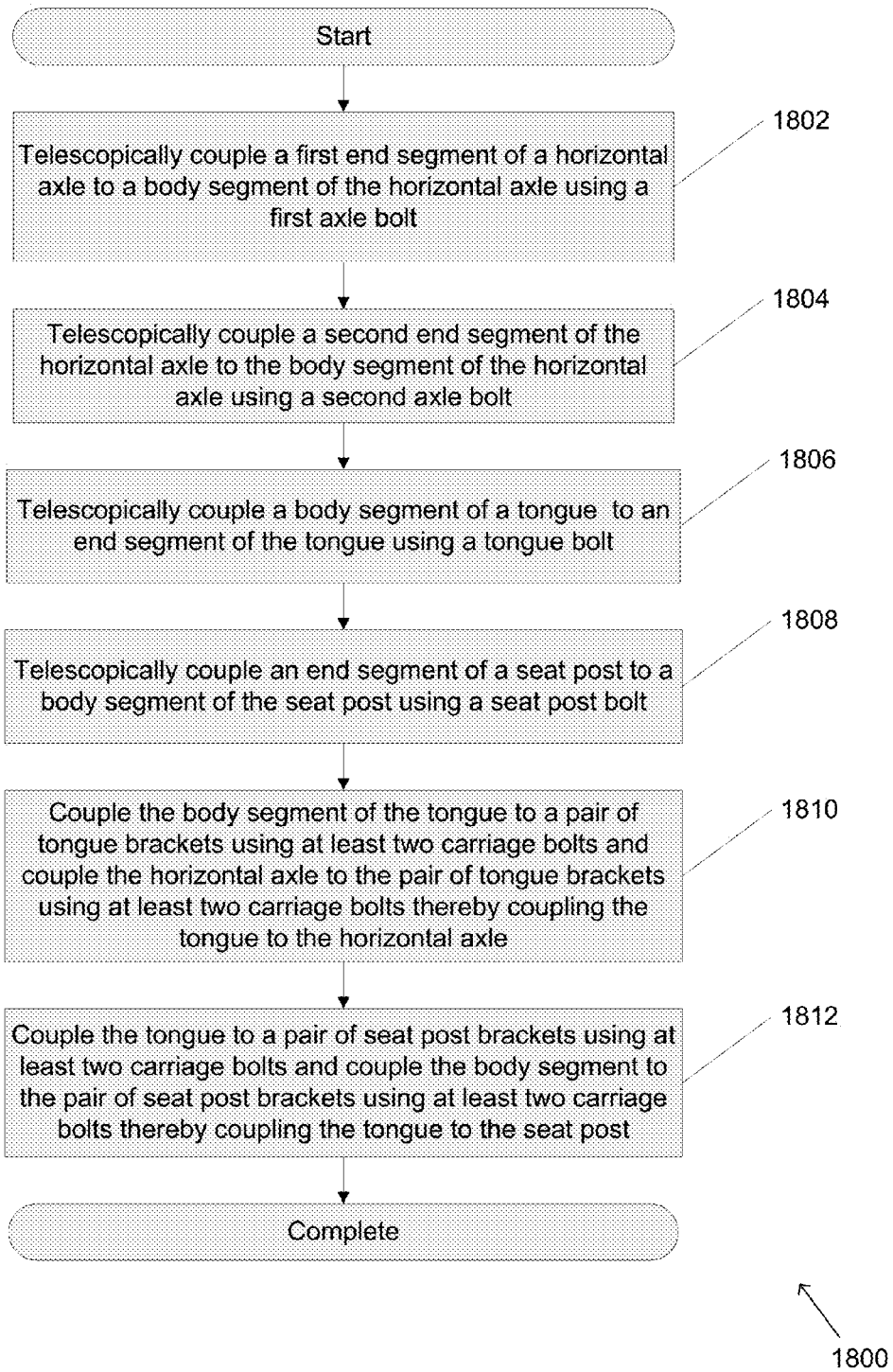
FIG. 18 is a flow chart illustrating a process of constructing an undercarriage in accordance with an embodiment of the invention.

A flow chart illustrating a process of constructing an undercarriage in accordance with an embodiment of the invention is shown in FIG. 18. The process 1800 includes selectively determining wheelchair width by telescopically coupling (1802) a first end segment of a horizontal axle to a body segment of the horizontal axle using a first axle bolt and telescopically coupling (1804) a second end segment of the horizontal axle to the body segment of the horizontal axle using a second axle bolt. In many embodiments, the first end segment of the horizontal axle and the second end segment of the horizontal axle and the body segment of the horizontal axle are all straight square bar tubes without curvature and have a plurality of opposite aligned through holes defined along on all four sides of the square bar tube. In several embodiments, the first axle bolt is inserted through oppositely aligned through holes of the first end segment of the horizontal axle with oppositely aligned through holes of the body segment of the horizontal axle. In various embodiments, the second axle bolt is inserted through oppositely aligned through holes of the second end segment of the horizontal axle with oppositely aligned through holes of the body segment of the horizontal axle. The process may also include selectively determining wheelchair length by telescopically coupling (1806) a body segment of a tongue to an end segment of the tongue using a tongue bolt. In many embodiments, the end segment of the tongue and the body segment of the tongue are straight square bar tubes without curvature and have a plurality of opposite aligned through holes defined along on all four sides of the square bar tube. In several embodiments, the tongue bolt is inserted through oppositely aligned through holes of the end segment of the tongue with oppositely aligned through holes of the body segment of the tongue. The process may further include selectively determining wheelchair seat height by telescopically coupling (1808) an end segment of a seat post to a body segment of the seat post using a seat post bolt. In various embodiments, the end segment of the seat post and the body segment of the seat post are straight square bar tubes without curvature and have a plurality of opposite aligned through holes defined along on all four sides of the square bar tube. In many embodiments, the seat post bolt is inserted through oppositely aligned through holes of the end segment of the seat post with oppositely aligned through holes of the body segment of the seat post. The process may include coupling (1810) the body segment of the tongue to a pair of tongue brackets using at least two carriage bolts and coupling the horizontal axle to the pair of tongue brackets using at least two carriage bolts thereby coupling the tongue to the horizontal axle. The process may also include coupling (1812) the tongue to a pair of seat post brackets using at least two carriage bolts and coupling the body segment to the pair of seat post brackets using at least two carriage bolts thereby coupling the tongue to the seat post. In many embodiments, seat post tilt may be adjusted by selecting from a plurality of interconnected and overlapping square holes defined through the pair of seat post brackets for receipt of a carriage bolt as described above.

Although specific processes for constructing a wheelchair and undercarriage are discussed above with respect to FIG. 17 and FIG. 18, any variety of processes for constructing a wheelchair or undercarriage as appropriate to the requirements of constructing a specific wheelchair or undercarriage can be utilized in accordance with embodiments of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A wheelchair for ready assembly, the wheelchair comprising:

an undercarriage comprising:

a horizontal axle comprising a first end segment telescopically coupled to a body segment and a second end segment telescopically coupled to the body segment opposite the first end segment allowing for adjustment of a wheelchair width, wherein the body segment, the first end segment, and the second end segment each comprise a square bar tube, each square bar tube comprising a plurality of oppositely aligned through holes; and a tongue comprising a body segment telescopically coupled to an end segment allowing for adjustment of the wheelchair length, wherein the body segment and the end segment of the tongue each comprise a square bar tube, each square bar tube comprising a plurality of oppositely aligned through holes; and a seat post comprising an end segment telescopically coupled to a body segment allowing for adjusting the wheelchair seat height, wherein the end segment and the body segment of the seat post each comprise a square bar tube, each square bar tube comprising a plurality of oppositely aligned through holes, wherein the body segment of the seat post is coupled to the tongue of the undercarriage using a pair of seat post brackets having a plurality of interconnected and overlapping square holes for receipt of a carriage bolt;

wherein the body segment of the horizontal axle and the body segment of the tongue are coupled using a pair of tongue brackets thereby coupling the horizontal axle to the tongue; and a pair of wheels for mobility comprising:

a first wheel coupled to the first end segment of the horizontal axle using a first pair of wheel brackets having a plurality of interconnected and overlapping square holes for receipt of a carriage bolt to determine the angular orientation of the first wheel relative to the horizontal axle of the undercarriage; and a second wheel coupled to the second end segment of the horizontal axle using a second pair of wheel brackets having a plurality of interconnected and overlapping square holes for receipt of a carriage bolt to determine the angular orientation of the second wheel relative to the horizontal axle of the undercarriage; and a swivel wheel coupled to the tongue of the undercarriage to support the wheelchair and provide mobility; and a seat bottom coupled to the end segment of the seat post for load-bearing support; and a seatback rotatably coupled to the seat bottom for back support.

2. The wheelchair of claim 1, wherein the first end segment of the horizontal axle is coupled to the body segment of the horizontal axle by inserting a first axle bolt through oppositely aligned through holes of the first end segment with oppositely aligned through holes of the body segment of the horizontal axle.

3. The wheelchair of claim 2, wherein the second end segment of the horizontal axle is coupled to the body segment of the horizontal axle by inserting a second axle bolt through oppositely aligned through holes of the second end segment with oppositely aligned through holes of the body segment of the horizontal axle.

4. The wheelchair of claim 3, wherein the end segment of the tongue is coupled to the body segment of the tongue by inserting a tongue bolt through oppositely aligned through holes of the end segment of the tongue with oppositely aligned through holes of the body segment of the tongue.

5. The wheelchair of claim 4, wherein the end segment of the seat post is coupled to the body segment of the seat post by inserting a seat post bolt through oppositely aligned through holes of the end segment of the seat post with oppositely aligned through holes of the body segment of the seat post.

6. The wheelchair of claim 1, wherein the first end segment of the horizontal axle and the second end segment of the horizontal axle and the body segment of the horizontal axle are all straight square bar tubes without curvature.

7. The wheelchair of claim 6, wherein the end segment of the tongue and the body segment of the tongue are straight square bar tubes without curvature.

8. The wheelchair of claim 7, wherein the end segment of the seat post and the body segment of the seat post are straight square bar tube without curvature.

9. The wheelchair of claim 1, further comprising:

a pair of rotatable seat brackets having:

a first rotatable seat bracket comprising:

a first end portion pivotally coupled to the end segment of the seat post of the undercarriage; and a second end portion coupled to the seat bottom of the wheelchair to allow for adjusting seat tilt in space; and a second rotatable seat bracket comprising:

a first end portion pivotally coupled to the end segment of the seat post of the undercarriage; and a second end portion coupled to the seat bottom of the wheelchair to allow for adjusting seat tilt in space;

wherein the pair of rotatable seat brackets have an adjustable orientation.

10. The wheelchair of claim 1, wherein the wheelchair has a gurney configuration such that the seatback aligns with the seat bottom to assume a horizontal position so that the wheelchair may function as a gurney.

11. A method of fabricating a wheelchair, the method comprising:

assembling an undercarriage having a horizontal axle, a tongue, and a seat post, wherein assembling the horizontal axle further includes:

setting a wheelchair width using a first end segment telescopically coupled to a body segment and a second end segment telescopically coupled to the body segment opposite the first end segment, wherein the body segment, the first end segment, and the second end segment each comprise a square bar tube, each square bar tube comprising a plurality of oppositely aligned through holes;

wherein assembling the tongue further includes:

setting wheelchair length using a body segment telescopically coupled to an end segment, wherein the body segment and the end segment of the tongue each comprise a square bar tube, each square bar tube comprising a plurality of oppositely aligned through holes;

wherein assembling the seat post further includes:

setting wheelchair seat height using an end segment telescopically coupled to a body segment, wherein the end segment and the body segment of the seat post each comprise a square bar tube, each square bar tube comprising a plurality of oppositely aligned through holes;

wherein assembling the undercarriage further includes:

setting seat post tilt using a pair of seat post brackets to couple the body segment of the seat post to the tongue, wherein setting seat post tilt further includes selecting from a plurality of interconnected and overlapping square holes defined through the rotatable seat post brackets for receipt of a carriage bolt; and setting wheelchair base using a pair of tongue brackets to couple the body segment of the tongue to the horizontal axle thereby coupling the horizontal axle to the tongue; and providing wheelchair mobility using a pair of wheels, wherein providing wheelchair mobility further includes:

setting wheel camber for a first wheel using a first pair of wheel brackets to couple the first wheel to the first end segment of the horizontal axle, wherein setting wheel camber further includes selecting from a plurality of interconnected and overlapping square holes defined through the first pair of wheel brackets for receipt of a carriage bolt to determine the angular orientation of the first wheel relative to the horizontal axle of the undercarriage; and setting wheel camber for a second wheel using a second pair of wheel brackets to couple the second wheel to the second end segment of the horizontal axle, wherein setting wheel camber further includes selecting from a plurality of interconnected and overlapping square holes defined through the second pair of wheel brackets for receipt of a carriage bolt to determine the angular orientation of the second wheel relative to the horizontal axle of the undercarriage; and providing additional wheelchair mobility and support using a swivel wheel, wherein providing additional wheelchair mobility and support further includes coupling the swivel wheel to the tongue of the undercarriage; and providing load-bearing support using a seat bottom, wherein providing load-bearing support further includes coupling the seat bottom to the end segment of the seat post; and providing back support using a seatback, wherein providing back support further includes coupling the seatback to the seat bottom.

12. The method of claim 11, wherein setting the wheelchair width further includes coupling the first end segment of the horizontal axle coupled to the body segment of the horizontal axle by inserting a first axle bolt through oppositely aligned through holes of the first end segment of the horizontal axle with oppositely aligned through holes of the body segment of the horizontal axle.

13. The method of claim 12, wherein setting the wheelchair width further includes coupling the second end segment of the horizontal axle to the body segment of the horizontal axle by inserting a second axle bolt through oppositely aligned through holes of the second end segment of the horizontal axle with oppositely aligned through holes of the body segment of the horizontal axle.

14. The method of claim 13, wherein the setting wheelchair length further includes coupling the end segment of the tongue to the body segment of the tongue by inserting a tongue bolt through oppositely aligned through holes of the end segment of the tongue with oppositely aligned through holes of the body segment of the tongue.

15. The method of claim 14, wherein the setting wheelchair seat height further includes coupling the end segment of the seat post to the body segment of the seat post by inserting a seat post bolt through oppositely aligned through holes of the end segment of the seat post with oppositely aligned through holes of the body segment of the seat post.

16. The method of claim 11, wherein the setting wheelchair length further includes using all straight square bar tubes without curvature for the first end segment of the horizontal axle and the second end segment of the horizontal axle and the body segment of the horizontal axle.

17. The method of claim 16, wherein the setting wheelchair length further includes using straight square bar tubes without curvature for the end segment of the tongue and the body segment of the tongue.

18. The method of claim 17, wherein the setting wheelchair seat height further includes using straight square bar tubes without curvature for the end segment of the seat post and the body segment of the seat post.

19. The method of claim 11, further comprising:

providing adjustable seat tilt using a pair of rotatable seat brackets, wherein providing adjustable seat tilt further includes:

coupling a first rotatable seat bracket, wherein coupling the first rotatable seat bracket further includes:

pivotally coupling a first end portion to the end segment of the seat post of the undercarriage; and coupling a second end portion to the seat bottom of the wheelchair; and coupling a second rotatable seat bracket, wherein coupling the second rotatable seat bracket further includes:

pivotally coupling a first end portion to the end segment of the seat post of the undercarriage; and coupling a second end portion to the seat bottom of the wheelchair;

wherein providing adjustable seat tilt further includes an adjustable orientation using the pair of rotatable seat brackets.

20. The method of claim 11, wherein the fabricating the wheelchair includes providing for a gurney configuration by aligning the seatback with the seat bottom to assume a horizontal position.

* * * * *